US008740016B2

(12) United States Patent
Zhou

(10) Patent No.: US 8,740,016 B2
(45) Date of Patent: Jun. 3, 2014

(54) CONTROL DEVICE AND CONTAINER FOR SPOUTING DRINK, AND CONTROL METHOD THEREOF

(76) Inventor: Yunping Zhou, Shanghai (CN)

( * ) Notice: Subject to any disclaimer, the term of this patent is extended or adjusted under 35 U.S.C. 154(b) by 74 days.

(21) Appl. No.: 13/229,776

(22) Filed: Sep. 12, 2011

(65) Prior Publication Data

US 2012/0061419 A1 Mar. 15, 2012

(30) Foreign Application Priority Data

Sep. 13, 2010 (CN) ..... 2010 1 0279334

(51) Int. Cl.
*B67D 1/00* (2006.01)
*B67D 7/14* (2010.01)

(52) U.S. Cl.
USPC ..... 222/54; 222/81

(58) Field of Classification Search
USPC ..... 222/54, 200, 1, 81–83, 91, 394, 464.1, 222/464.2, 393; 215/355; 220/277, 258.1, 220/258.3
See application file for complete search history.

(56) References Cited

U.S. PATENT DOCUMENTS 2,732,017 A * 1/1956 Fleming ..... 169/62
3,053,422 A * 9/1962 Tenison et al. ..... 222/399
3,399,806 A * 9/1968 Lucas ..... 222/545
4,121,734 A * 10/1978 Soong et al. ..... 222/54
4,816,262 A * 3/1989 McMullen ..... 424/467
4,896,457 A * 1/1990 Pitcher ..... 47/82
5,398,850 A * 3/1995 Sancoff et al. ..... 222/386.5
5,553,741 A * 9/1996 Sancoff et al. ..... 222/1
5,605,710 A * 2/1997 Pridonoff et al. ..... 426/86
6,223,937 B1 * 5/2001 Schmidt ..... 222/54
7,213,728 B2 * 5/2007 Kutsch et al. ..... 222/649
2006/0261028 A1 * 11/2006 Dubach ..... 215/257

OTHER PUBLICATIONS

Lehr, Jay; Keeley, Jack; Lehr, Janet (2005). Water Encyclopedia, vols. 1-5. (pp. 450-451). John Wiley & Sons.*

* cited by examiner

*Primary Examiner* — Paul R Durand
*Assistant Examiner* — Benjamin R Shaw

(57) ABSTRACT

A container for spouting drink which contains gas, includes: a container structure including container body for containing the drink, wherein the container body has a container opening; and a control device, including: a drink-decomposed plug provided on the container opening, which is capable of being decomposed by the drink, a blocking element positioned inside the container body, for preventing the drink-decomposed plug from contacting with the drink, and a triggering element for disabling the blocking element when needed, wherein when the triggering element disables the blocking element, the drink contacts with the drink-decomposed plug and starts decomposing the drink-decomposed plug, and after the drink-decomposed plug is completely decomposed, the drink spouts out of the container body.

11 Claims, 28 Drawing Sheets

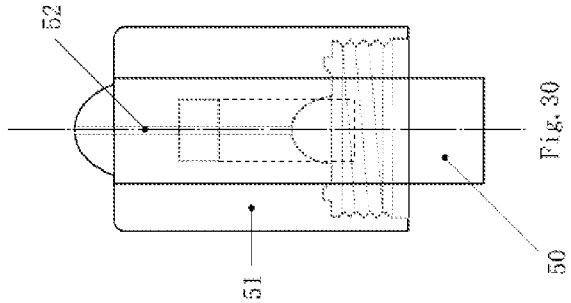
Fig. 30
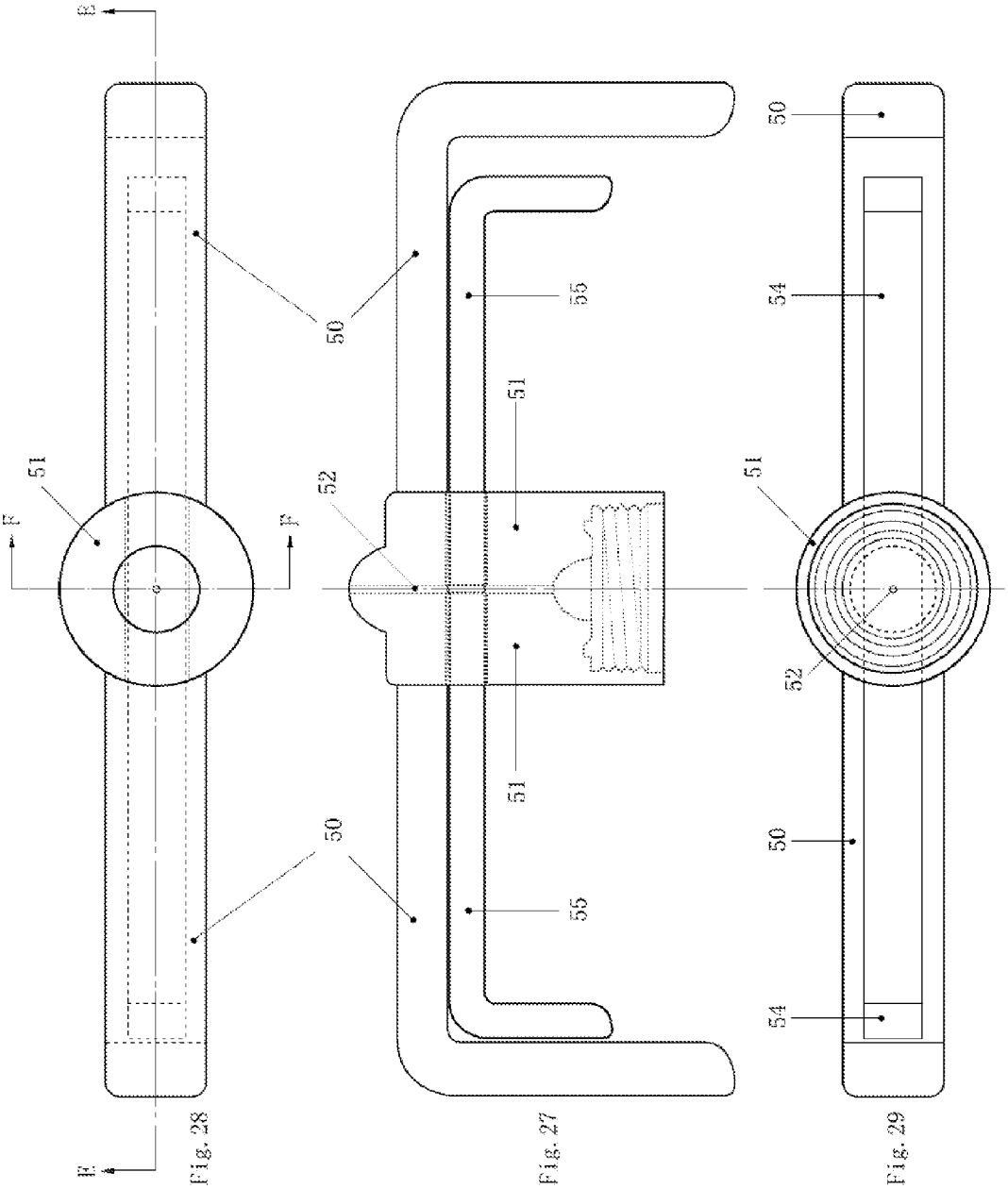
Fig. 28
Fig. 27
Fig. 29

CONTROL DEVICE AND CONTAINER FOR SPOUTING DRINK, AND CONTROL METHOD THEREOF

BACKGROUND OF THE PRESENT INVENTION

1. Field of Invention

The present invention relates to a drink plug capable of opening automatically and controlling spouting, and its container, and more particularly to a control device and a container for spouting drink, and a control method thereof.

2. Description of Related Arts

All over the world, drinking and opening of the champagne (foam liquor) means happiness, success, festival and celebration. At the moment the champagne (foam liquor) is opened, the low and deep sound moves people's tender hearts. The continuous, dense and soft foam spouts out of the bottle, and dances in the crystal goblets. For agreement, for the new born, for birthday, or for celebrating own life, it deserves the wonderful moments. However, obvious drawbacks of the plugging art in the conventional champagne (foam liquor) can not be ignored.

Firstly, it is unsafe. Everyone who has contacted with or drunk the champagne (foam liquor) will know that, it is unsafe. Storing and opening should be very careful, especially the opening gesture must be correct, since the plug will pop out to hurt people, and the whole opening process need to be manual.

Secondly, it is not economical. Besides that the opening gesture must be correct to avoid hurting people by the popping out plug, it is hard to not waste the champagne (foam liquor) when opening. The opening operation has some difficulty, and in certain circumstances, the expansive champagne (foam liquor) spouts out to air for better celebration effect, and thus certainly that champagne (foam liquor) is wasted and the environment is polluted.

Finally, it is not widespread. Although the spouting way of champagne (foam liquor) has exceptional charm and joy, and special ability to form happiness atmosphere, it is not widespread. Except the champagne (foam liquor), other drinks do not possess the characters.

SUMMARY OF THE PRESENT INVENTION

An object of the present invention is to provide an effervescent decomposed plug as a last sealing element of a drink container, wherein an effervescent decomposed action, which occurs when the drink inside the container contacts with the effervescent decomposed plug, is used as a control device for automatically delaying opening and spouting the drink. After removing a moistureproof cover, screwing down a device cover, the opening process of the container and spouting of the drink is automatic, and spouting of the drink has a certain delay time. Since the effervescent decomposed plug is used as the last sealing element of the drink container, the opening process is actually that the effervescent decomposed plug is decomposed into $CO_2$ gas and liquid by the drink. Therefore, after the effervescent decomposed plug is totally converted into $CO_2$ gas and liquid, the container finishes opening, and the drink spouts out of the container at a high speed under pressure. During the process, no hard object pops out and the process is definitely safe, so that the problem of unsafe and inconvenient operation is solved.

The present invention has a container cover having a concave central portion, in such a manner that the drink spouts into the air can fall back to the concave central portion of the container cover. The drink can be drunk to avoid waste and keep environment tiny, so as to solve the problem of waste and pollution.

The present invention integrates all control devices into the container cover. The effervescent decomposed plug preferably adopts the method of tablet pressing in the field of medicine production for industrial manufacture. The container cover preferably adopts plastic materials, and is assembled by elements of molding injection. The container cover can be connected with the container by screw thread which is most economical and common at present, so that it can be applied in various air-charged and air-contained drink packing to make more drinks have function of spouting for fun, so as to solve the problem of not widespread.

Accordingly, in order to accomplish the above objects, the present invention provides a control device and a container for spouting drink, comprising:

a control device comprising a moistureproof cover, a device cover, an effervescent decomposed plug, and a sealing cover; and a container structure comprising a container cover having a concave central portion and a container body.

The moistureproof cover has a moistureproof cover inner screw thread on an inner side thereof, for screwing with an device cover top outer screw thread. A moistureproof cover closing ring is provided on a lower portion of the moistureproof cover inner screw thread.

The device cover has the device cover top outer screw thread on an outer side of a top thereof, for screwing with the moistureproof cover inner screw thread.

A device cover central cylinder is provided on a central portion of the device cover. The device cover central cylinder has a device cover central cylinder drink channel and a device cover chamber, the device cover central cylinder drink channel is on an upper portion thereof, and the device cover chamber is on a lower portion thereof. A top end of the device cover central cylinder drink channel has an opening on a top of the device cover central cylinder, and a bottom end communicated through an top end of the device cover chamber. A bottom end of the device cover chamber has an opening on a bottom of the device cover central cylinder. An outer diameter of the device cover central cylinder is equal to an inner diameter of a sealing cover central cylinder thimble sleeve. The device cover central cylinder is sleeved inside the sealing cover central cylinder thimble sleeve, and the bottom of the device cover central cylinder is muff-coupled with a top end of a device cover opening thimble via a muff-coupling socket.

A bottom end of the device cover opening thimble is coniform and matching with a coniform film sealing layer having a fragile groove which is provided on an inner side of the bottom end of the sealing cover central cylinder thimble sleeve. The device cover opening thimble has a plurality of device cover opening thimble drink channels through from top to bottom in a central portion thereof. A top end of the device cover opening thimble drink channel has an opening communicated through the device cover chamber which is provided inside the bottom end of the device cover central cylinder. An opening of the top end of the device cover chamber has a screen mounted thereon and communicated through the device cover central cylinder drink channel. The opening of the top end of the device cover central cylinder drink channel is communicated through a device cover drink nozzle which is provided on a top end of the device cover.

A device cover circular sealing ridge ring is provided between the device cover central cylinder and an outer wall of the device cover, and matches with a sealing cover circular sealing groove ring. A top layer of the device cover provided between the device cover circular sealing ridge ring and the outer wall of the device cover has a plurality of device cover decompressing pores through the top layer. A device cover bottom inner screw thread is provided on a screw joint of the device cover and the sealing cover, for screwing with a sealing cover top outer screw thread. A plurality of device cover locking barbs is provided on an inner side of a bottom end of the device cover bottom inner screw thread. A device cover closing ring having a handle is provided under the device cover locking barbs. A device cover screwing sleeve sleeves on an outer side of a middle portion of the device cover.

A multi-layers annular ridge sealing sleeve is coating firmly on the effervescent decomposed plug. The effervescent decomposed plug and the multi-layers annular ridge sealing sleeve fill the device cover chamber inside the bottom end of the device cover central cylinder. The sealing cover top outer screw thread is provided on the outer side of the top end of the sealing cover, for screwing with the device cover bottom inner screw thread. The sealing cover central cylinder thimble sleeve is provided on a central portion of the sealing cover. The coniform film sealing layer having the fragile groove is provided on the inner side of the bottom end of the sealing cover central cylinder thimble sleeve. The coniform film sealing layer having the fragile groove matches with the coniform bottom end of the device cover opening thimble. The sealing cover circular sealing groove ring is provided between the opening on the top end of the sealing cover central cylinder thimble sleeve and the outer side of the top end of the sealing cover. The sealing cover circular sealing groove ring matches with the device cover circular sealing ridge ring. The bottom end of the sealing cover central cylinder thimble sleeve is muff-coupled with a top end of a cylindrical positioning ridge ring which is provided on a bottom of the container body. A sealing cover bottom inner screw thread is provided on the inner side of the bottom end of the sealing cover, for screwing with a screwing head outer screw thread on an outer side of a screwing head which is provided on the central portion of the container cover having a concave central portion. A sealing cover closing ring having a handle is provided under the sealing cover bottom inner screw thread. The screwing head is provided in a deepest position of the container cover having a concave central portion. The screwing head outer screw thread is provided on the outer side of the top end of the screwing head, for screwing with the sealing cover bottom inner screw thread. A screwing ring of the container cover having a concave central portion is provided at a screwing joint of the container cover having a concave central portion and the container body. A screwing ring inner screw thread is provided on an inner side of the screwing ring. A closing ring having a handle of the container cover having a concave central portion is provided in a bottom end of the screwing ring.

A container opening of the container body is provided at a screwing joint of the container body and the container cover having a concave central portion. A container opening outer screwing thread is provided on an outer side of the container opening, and screws with the screwing ring inner screw thread on the inner side of the screwing ring with screw thread. The cylindrical positioning ridge ring inside the container body is provided on the central portion of the bottom of the container body. The cylindrical positioning ridge ring has a plurality of lateral channels on a bottom side thereof. A top end of the cylindrical positioning ridge ring is muff-coupled with a bottom end of the sealing cover central cylinder thimble sleeve.

A control method of spouting drink, comprises:

providing the effervescent decomposed plug as a last sealing element before the drink spouts; and pushing the coniform film sealing layer having the fragile groove on the bottom side of inner end of the sealing cover central cylinder thimble sleeve with the device cover opening thimble by opening moistureproof cover on very top and screwing down the device cover, wherein the drink inside the container body flows into the bottom of the device cover chamber provided inside the device cover central cylinder and having the effervescent decomposed plug positioned therein via the lateral channels and the device cover opening thimble drink channel, contacts and has continuous effervescent decomposed reaction with the effervescent decomposed plug, so as to decompose the effervescent decomposed plug into $CO_2$ gas and liquid from bottom to top, wherein after the effervescent decomposed plug is totally decomposed, the drink inside the container body flows into the device cover chamber via the lateral channels and the device cover opening thimble drink channel under pressure, and then spouts out of the container body via the device cover central cylinder drink channel communicated with the device cover chamber and the device cover drink nozzle at a high speed.

On another words, the present invention provides a container for spouting drink which contains gas, comprising:

a container structure comprising container body for containing the drink, wherein the container body has a container opening; and a control device, comprising: a drink-decomposed plug provided on the container opening, which is capable of being decomposed by the drink, a blocking element positioned inside the container body, for preventing the drink-decomposed plug from contacting with the drink, and a triggering element for disabling the blocking element when needed, wherein when the triggering element disables the blocking element, the drink contacts with the drink-decomposed plug and starts decomposing the drink-decomposed plug, and after the drink-decomposed plug is completely decomposed, the drink spouts out of the container body.

On another words, the present invention provides a control method of spouting drink, comprising:

providing a drink-decomposed plug on a container opening of a container body, which is capable of being decomposed by the drink; and disabling a blocking element positioned inside the container body for preventing said drink-decomposed plug from contacting with the drink, so as to allow the drink contacts with said drink-decomposed plug, wherein after said blocking element is disabled, the drink contacts with said drink-decomposed plug and starts decomposing said drink-decomposed plug, and after said drink-decomposed plug is completely decomposed, the drink spouts out of said container body.

Beneficial Effect:

The control device and container for spouting drink, and the control method thereof utilize theory of effervescent decomposing systemically, uses the effervescent decomposed plug as the last sealing element of drink containers before the drink spouts, and the effervescent decomposed reaction occurring when the drink in the container contacts with the effervescent decomposed plug positioned inside the container cover, is used as the control means for automatically delaying opening and spouting the drink. Safety, economical efficiency, operation, entertainment and universality is all increased creatively. Accident that objects pop out to hurt people, environment pollution and waste is avoided. On the other hand, the present invention has low production cost and wide application, and thus more choices are provided to produce happy atmosphere for celebration, but not limited to champagne (foam liquor) only.

The control device for spouting drink according to a preferred embodiment of the present invention adopts plastic materials, and is assembled with elements produced by molding injection. The existing technology can produce the control device on a large scale and has low cost and good effect. The effervescent decomposed plug according to a preferred embodiment of the present invention is produced by tablet pressing in the field of medicine manufacture. The existing technology can produce the effervescent decomposed plug on a large scale and has low cost and good effect.

These and other objectives, features, and advantages of the present invention will become apparent from the following detailed description, the accompanying drawings, and the appended claims.

BRIEF DESCRIPTION OF THE DRAWINGS

Structure of the present invention is illustrated as below:

FIG. 27 is a front view of a switch handle.

FIG. 28 is a planform view of the switch handle.

FIG. 29 is a bottom view of the switch handle.

FIG. 30 is a side view of the switch handle.

REFERENCE NUMBERS OF ELEMENTS IN THE DRAWINGS

Figure 1:
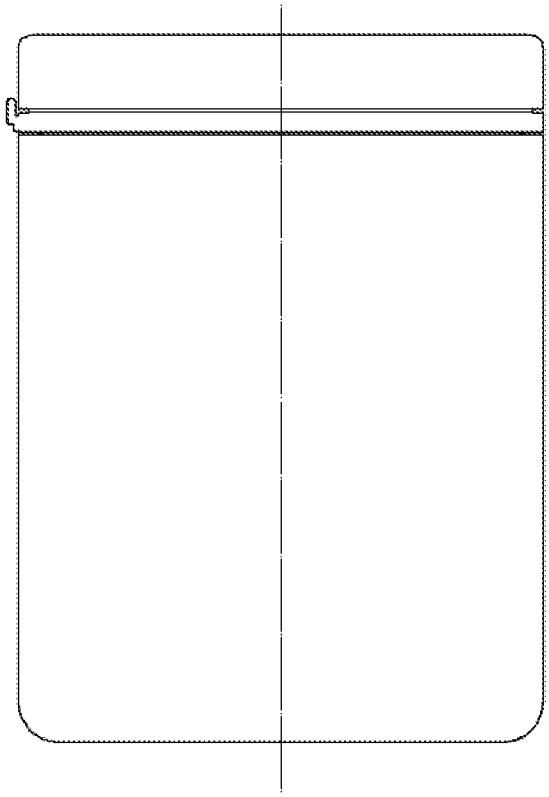
FIG. 1 is a perspective view of a control device and a container for spouting drink according to a first preferred embodiment of the present invention.
Figure 2:
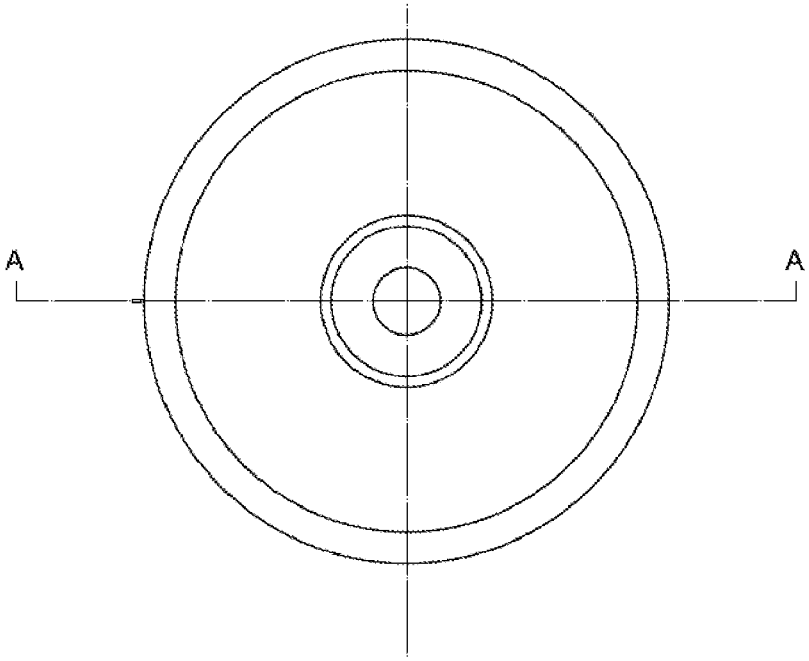
FIG. 2 is a planform view of FIG. 1.
Figure 3:
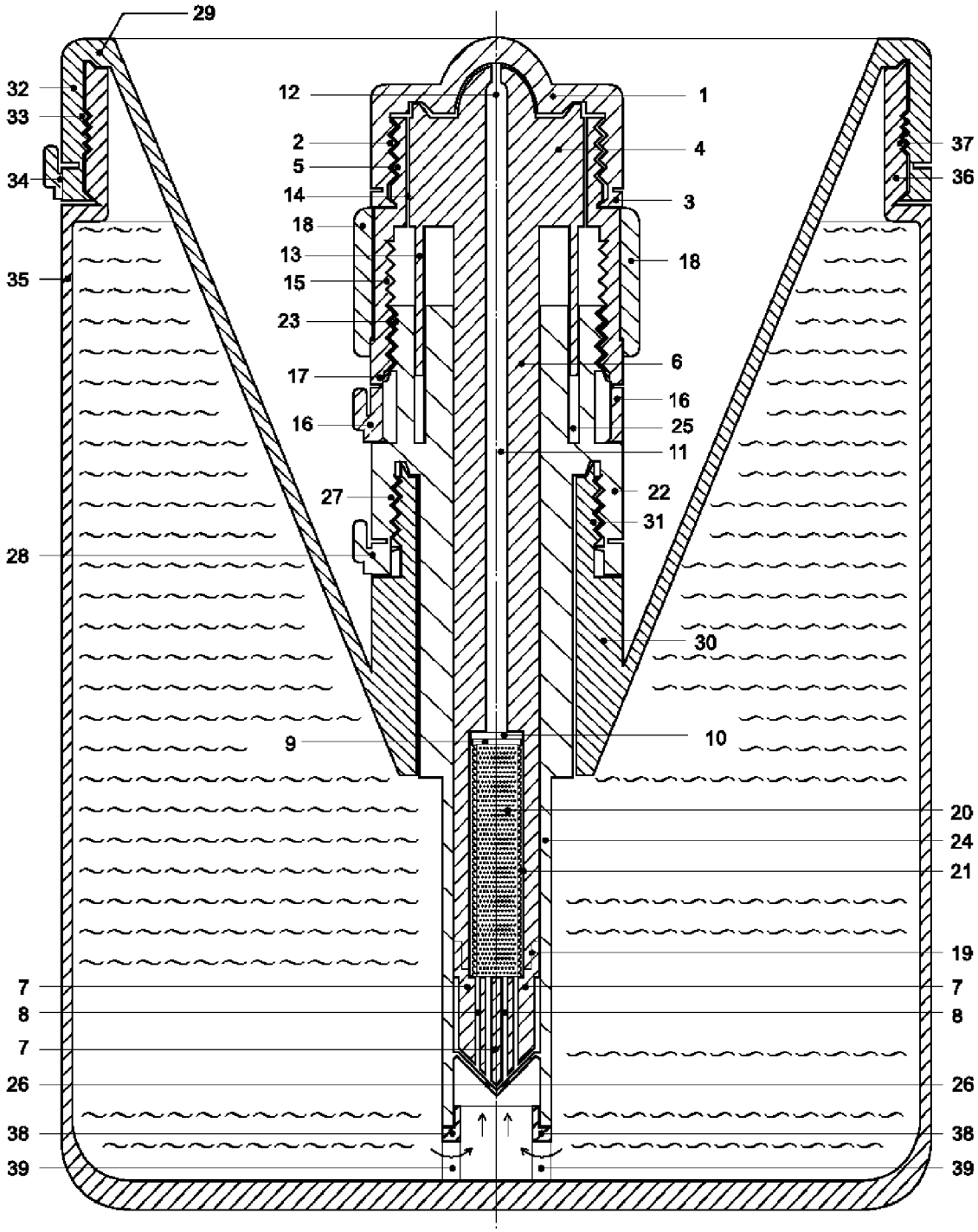
FIG. 3 is an A-A sectional view in FIG. 2
Figure 4:
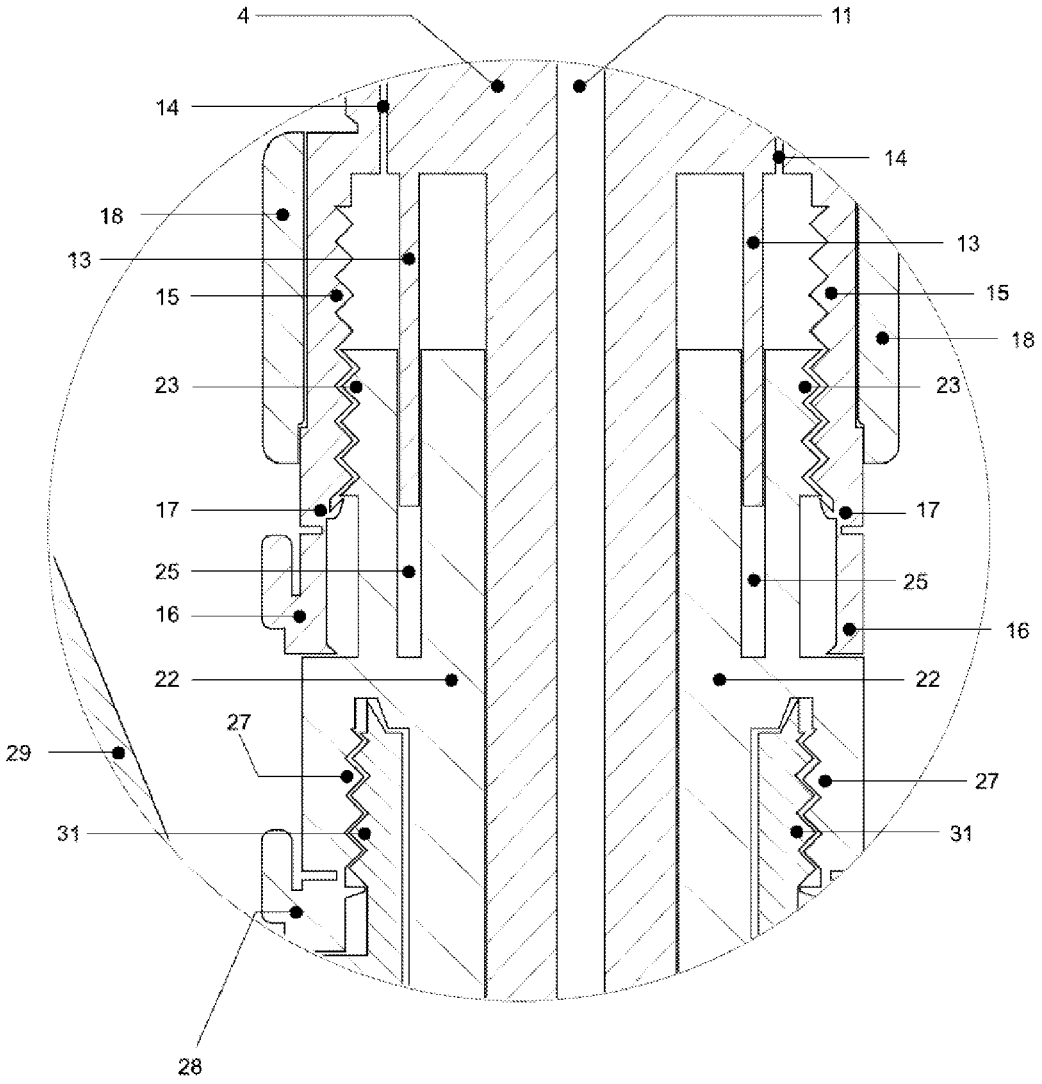
FIG. 4 is a partial enlarge view of FIG. 3.
Figure 5:
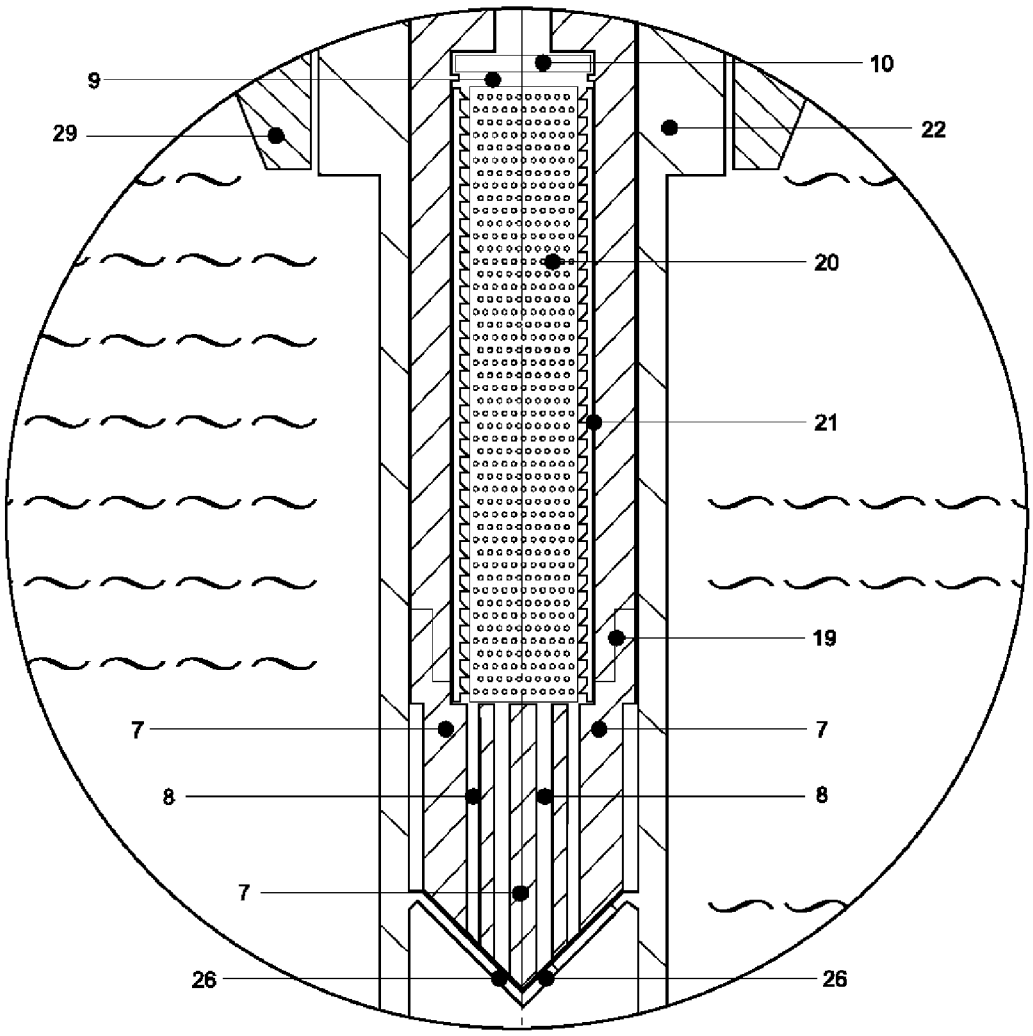
FIG. 5 is a partial enlarge view of FIG. 3.
Figure 6:
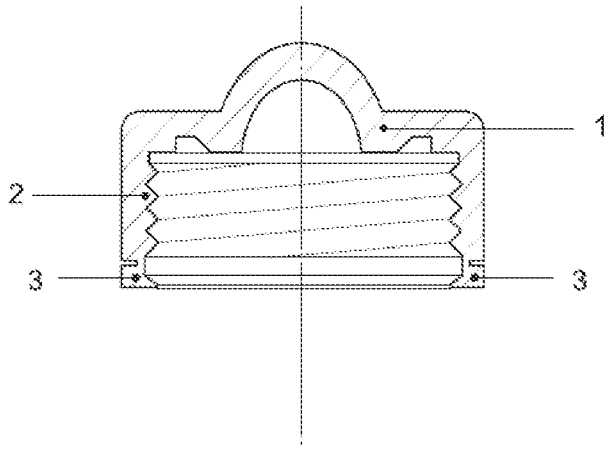
FIG. 6 is a sectional view of a moistureproof cover in FIG. 3.
Figure 7:
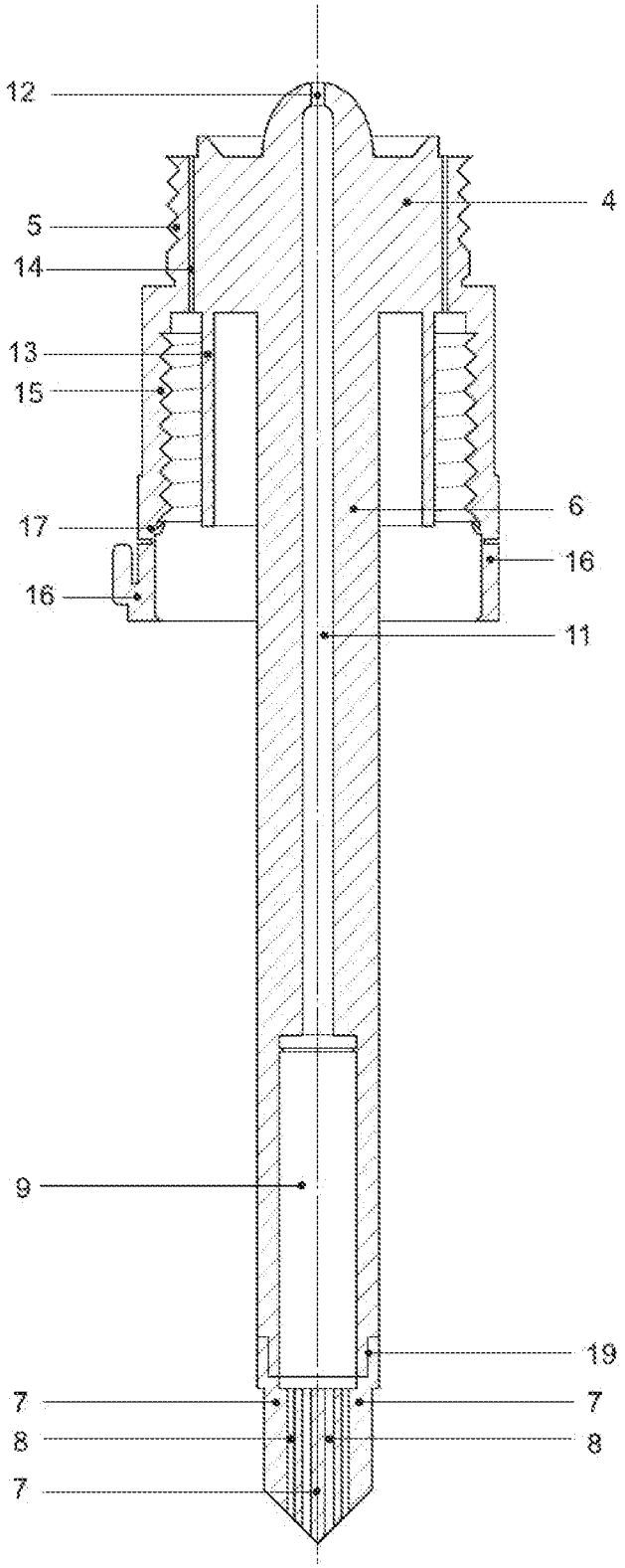
FIG. 7 is a sectional view of a device cover in FIG. 3.
Figure 8:
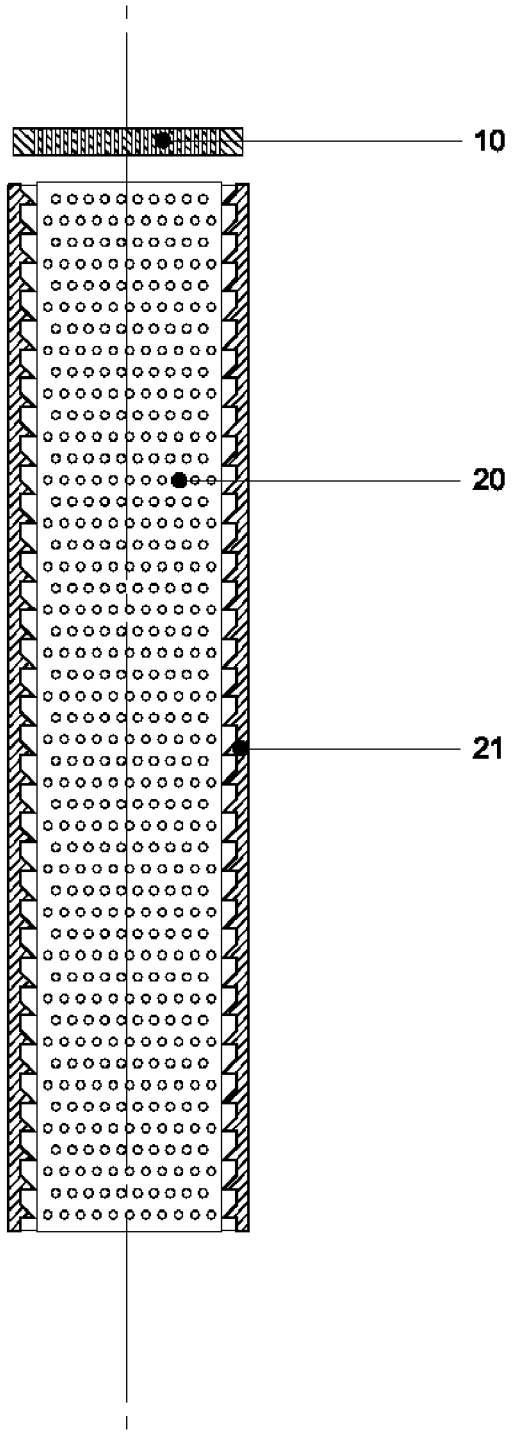
FIG. 8 is a sectional view of a effervescent decomposed plug and a screen in FIG. 3.
Figure 9:
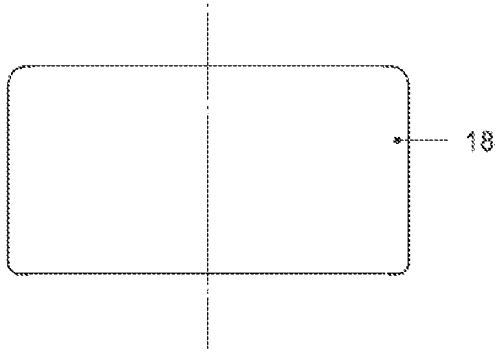
FIG. 9 is a perspective view of a device cover screwing sleeve.
Figure 10:
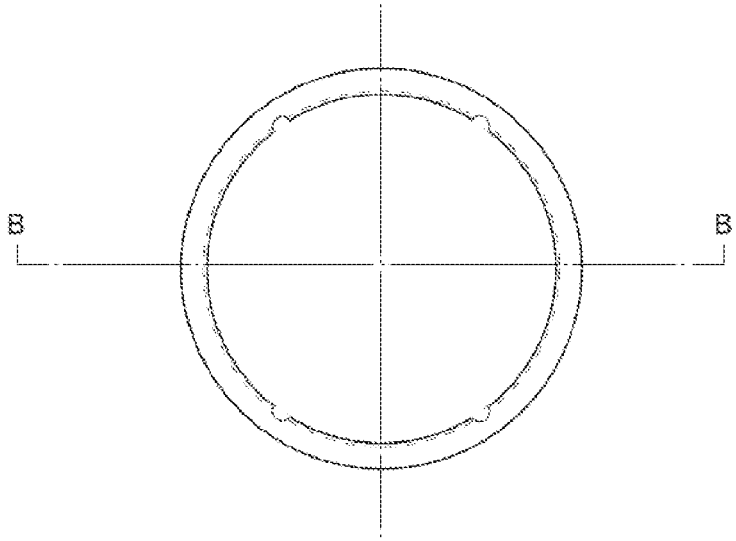
FIG. 10 is a planform view of FIG. 9.
Figure 11:
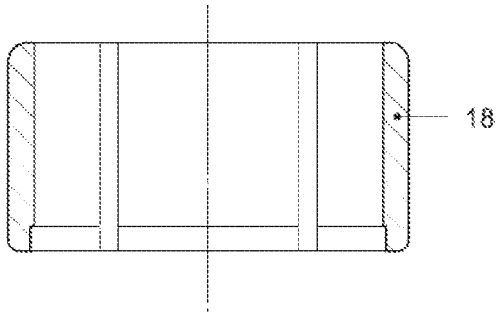
FIG. 11 is a B-B sectional view in FIG. 10.
Figure 12:
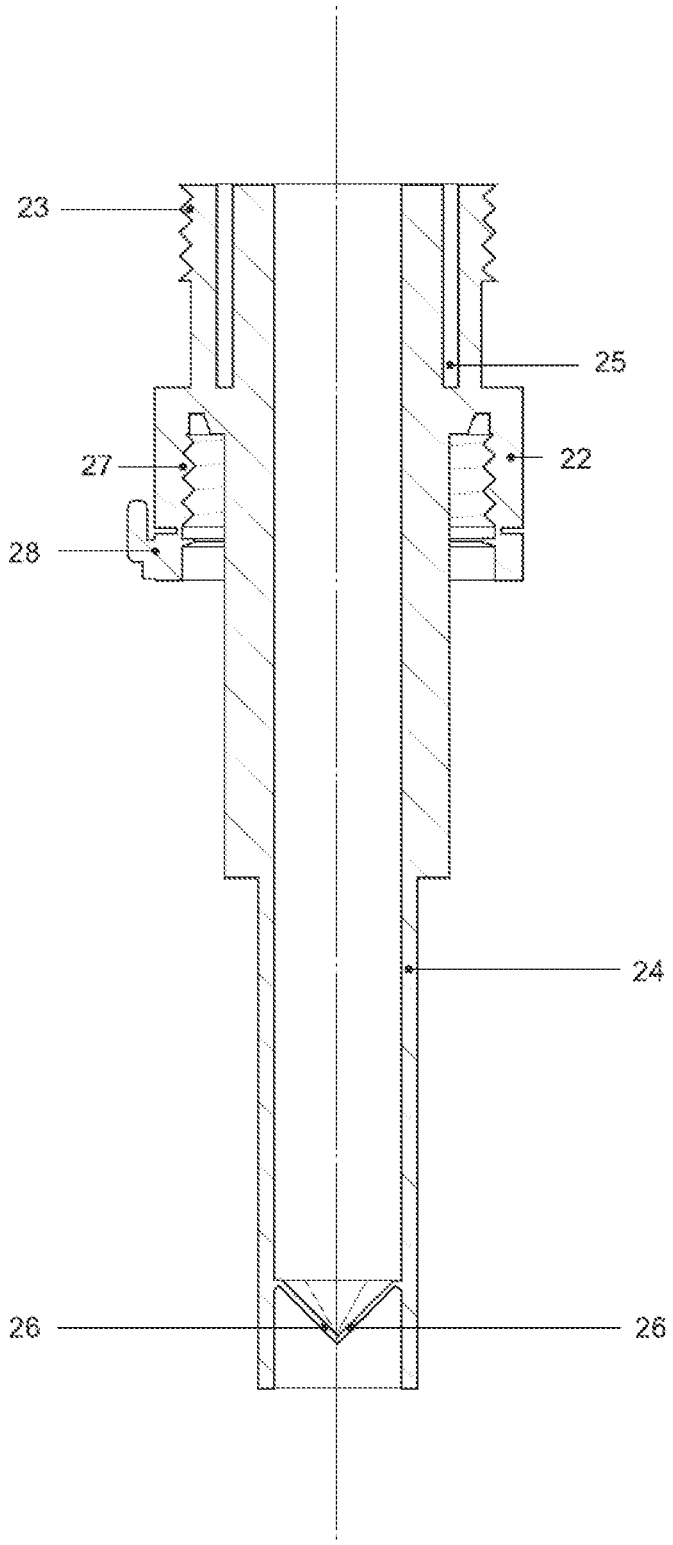
FIG. 12 is a sectional view of a sealing cover in FIG. 3.
Figure 13:
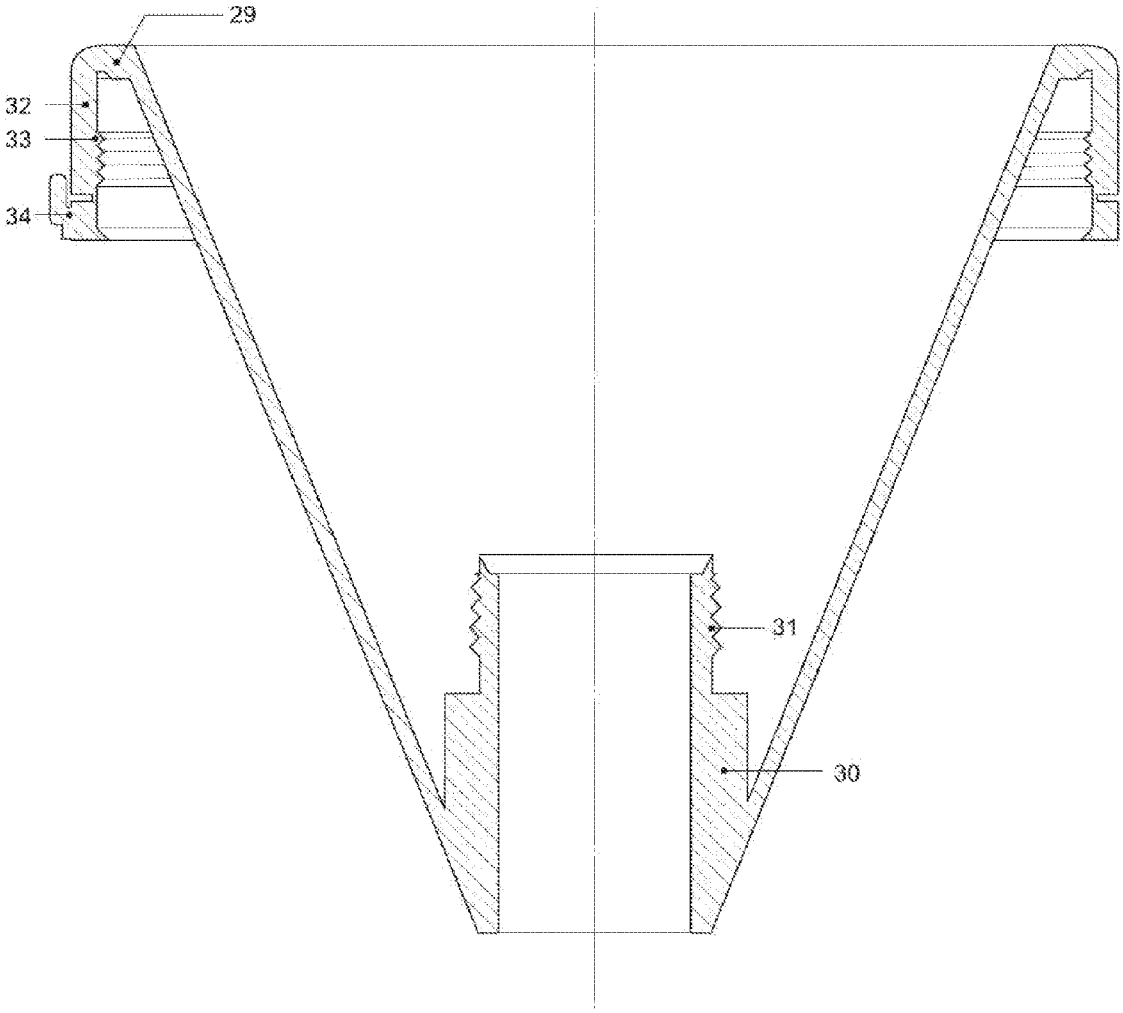
FIG. 13 is a sectional view of a container cover in FIG. 3.
Figure 14:
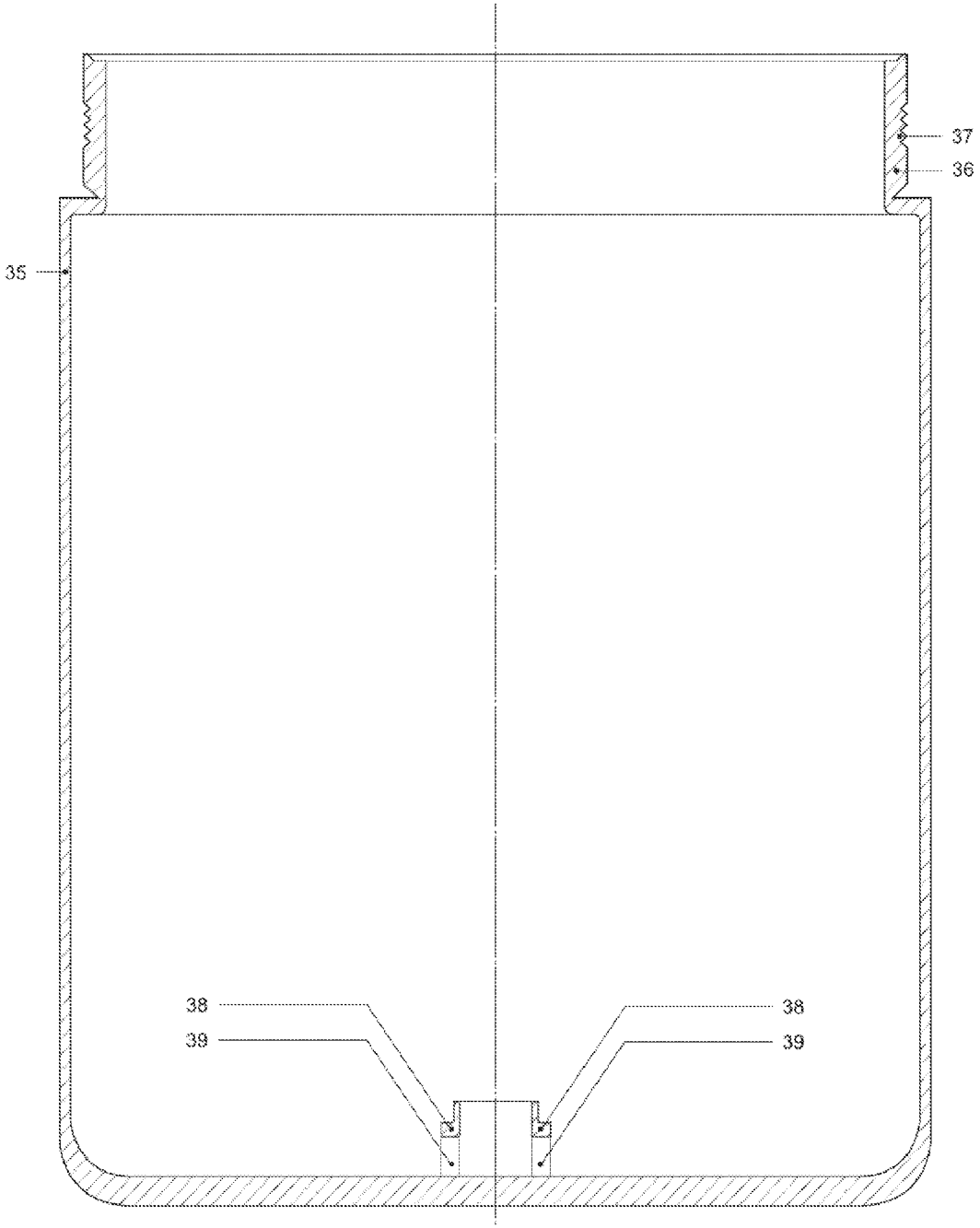
FIG. 14 is a sectional view of a container in FIG. 3.

1—moistureproof cover
2—moistureproof cover inner screw thread
3—moistureproof cover closing ring
4—device cover
5—device cover top outer screw thread
6—device cover central cylinder
7—device cover opening thimble
8—device cover opening thimble drink channel
9—device cover chamber
10—screen
11—device cover central cylinder drink channel
12—device cover drink nozzle
13—device cover circular sealing ridge ring
14—device cover decompressing pore
15—device cover bottom inner screw thread
16—device cover closing ring having a handle
17—device cover locking barbs
18—device cover screwing sleeve
19—muff-coupling socket
20—effervescent decomposed plug
21—multi-layers annular ridge sealing sleeve
22—sealing cover
23—sealing cover top outer screw thread
24—sealing cover central cylinder thimble sleeve
25—sealing cover circular sealing groove ring
26—coniform film sealing layer having a fragile groove
27—sealing cover bottom inner screw thread
28—sealing cover closing ring having a handle
29—container cover having a concave central portion
30—screwing head
31—screwing head outer screw thread
32—screwing ring
33—screwing ring inner screw thread
34—closing ring having a handle of the container cover having the concave central portion
35—container body
36—container opening
37—container opening outer screw thread
38—cylindrical positioning ridge ring
39—lateral channel
40—device cover crew-cut piston thimble
41—device cover crew-cut piston thimble drink channel
42—puddle
43—piston
44—piston push rod

45—device cover crew-cut opening head
46—device cover crew-cut opening head drink channel
47—lateral hole
48—valve
49—conventional drink container having an opening of screw thread
50—switch handle
51—switch handle central cylinder
52—moistureproof cover drink channel
53—chamber
54—chamber screw thread
55—transverse channel
56—switch trigger
57—switch trigger drink channel
58—cup

DETAILED DESCRIPTION OF THE PREFERRED EMBODIMENT

First Preferred Embodiment

Referring to FIGS. 1-14 of the drawings, a control device and a container for spouting drink, and a control method thereof are illustrated.

The control device for spouting drink comprises the follows.

A moistureproof cover 1 is provided on a very top of the control device for spouting drink, for maintaining a device cover drink nozzle 12 clean and preventing an effervescent decomposed plug 20 from moisture. The moistureproof cover 1 screws with a device cover 4 through screw thread. A moistureproof cover closing ring 3 under a moistureproof cover inner screw thread 2 can show clearly whether the moistureproof cover 1 has been opened.

The device cover 4 has a device cover top outer screw thread 5 on an outer side of a top thereof, for screwing with the moistureproof cover inner screw thread 2.

A device cover central cylinder 6 is provided on a central portion of the device cover 4. The device cover central cylinder 6 has a device cover central cylinder drink channel 11 and a device cover chamber 9, the device cover central cylinder drink channel 11 is on an upper portion thereof, and the device cover chamber 9 is on a lower portion thereof. A top end of the device cover central cylinder drink channel 11 has an opening on a top of the device cover central cylinder 6, and a bottom end communicated through an top end of the device cover chamber 9. A bottom end of the device cover chamber 9 has an opening on a bottom of the device cover central cylinder 6. An outer diameter of the device cover central cylinder 6 is equal to an inner diameter of a sealing cover central cylinder thimble sleeve 24. The device cover central cylinder 6 is sleeved inside the sealing cover central cylinder thimble sleeve 24, the bottom of the device cover central cylinder 6 is muff-coupled with a top end of a device cover opening thimble 7 via a muff-coupling socket 19.

A bottom end of the device cover opening thimble 7 is coniform and matching with a coniform film sealing layer having the fragile groove 26 which is provided on an inner side of the bottom end of the sealing cover central cylinder thimble sleeve 24.

Since the coniform portion of the bottom end of the device cover opening thimble 7 attaches to an upper surface of the coniform film sealing layer having the fragile groove 26, the coniform film sealing layer having the fragile groove 26 will not be damaged by an inner container pressure. However, when screwing down the device cover 4, the coniform portion of the bottom end of the device cover opening thimble 7 can easily break the coniform film sealing layer having the fragile groove 26, and the fragile groove on the coniform film sealing layer having the fragile groove 26 ensures even opening. The device cover opening thimble 7 has a plurality of the device cover opening thimble drink channels 8 through from top to bottom in a central portion thereof. A top end of the device cover opening thimble drink channel 8 has an opening communicated through the device cover chamber 9 which is provided inside the bottom end of the device cover central cylinder 6.

An effervescent decomposed plug 20 is positioned inside the device cover chamber 9. The effervescent decomposed plug 20 comprises an effervescent decomposed ingredient consisting of citric acid or tartaric acid, an eatable plasticizer, and an eatable adhesive, and is formed by machine compressing. The effervescent decomposed plug 20 is dry, firm, and solid with mechanical strength. A preferred method to produce the effervescent decomposed plug 20 is tablets pressing in the field of medicine manufacture.

After the drink in the container contacts with the effervescent decomposed plug 20, $CO_2$ gas is produced continuously, and the effervescent decomposed plug 20 is decomposed within 1 minute, preferably less then 30 seconds but more than 15 seconds.

A multi-layers annular ridge sealing sleeve 21 is coating firmly on the effervescent decomposed plug 20. A function of the multi-layers annular ridge sealing sleeve 21 is to maintain airtightness while the effervescent decomposed plug 20 is decomposed into $CO_2$ gas and liquid from bottom to top, and to prevent the gas and the drink leak from side gaps. The multi-layers annular ridge sealing sleeve 21 and the device cover 4 can be formed integrally to reduce the number of elements, simplify producing procedure and increase assembling efficiency.

An opening of the top end of the device cover chamber 9 has a screen 10 mounted thereon and communicated through the device cover central cylinder drink channel 11. The opening of the top end of the device cover central cylinder drink channel 11 is communicated through a device cover drink nozzle 12 which is provided on a top end of the device cover 4. A function of the screen 10 is to produce more bubble and seeping more air into the spouting drink. The screen 10 and the device cover 4 can be formed integrally to reduce the number of elements, simplify producing procedure and increase assembling efficiency.

A device cover circular sealing ridge ring 13 is provided between the device cover central cylinder 6 and an outer wall of the device cover 4, and matches with a sealing cover circular sealing groove ring 25, having a function of enhancing a sealing effect between the device cover central cylinder 6 and the sealing cover central cylinder thimble sleeve 24.

A top layer of the device cover 4 provided between the device cover circular sealing ridge ring 13 and the outer wall of the device cover 4 has a plurality of device cover decompressing pores 14 through the top layer, for reducing a cavum pressure produced between the device cover 4 and a sealing cover 22 when screwing down the device cover 4. A device cover bottom inner screw thread 15 is provided on a screw joint of the device cover 4 and the sealing cover 22, for screwing with a sealing cover top outer screw thread 23.

A plurality of device cover locking barbs 17 are provided on an inner side of a bottom end of the device cover bottom inner screw thread 15, having a function of preventing a user from unscrewing and removing the device cover 4. After removing a device cover closing ring having a handle 16 under the device cover locking barbs 17, the device cover 4 can be screwed down via a device cover screwing sleeve 18 sleeved on an outer side of middle of the device cover 4.

A function of the device cover screwing sleeve 18 is for a user to screwing down the device cover 4 without touching the device cover 4, so as to avoid pollution of the device cover 4 by unclean hands of the user. After screwing down the device cover 4, the user removes the device cover screwing sleeve 18, and waits for the drink spouts into air via the device cover drink nozzle 12 and falls back to a central concave portion of a container cover having a concave central portion 29. The sealing cover top outer screw thread 23 is provided on the outer side of the top end of the sealing cover 22, for screwing with the device cover bottom inner screw thread 15. A sealing cover central cylinder thimble sleeve 24 is provided on a central portion of the sealing cover 22. The coniform film sealing layer having the fragile groove 26 is provided on the inner side of the bottom end of the sealing cover central cylinder thimble sleeve 24. The coniform film sealing layer having the fragile groove 26 matches with the coniform bottom end of the device cover opening thimble 7. A sealing cover circular sealing groove ring 25 is provided between the opening on the top end of the sealing cover central cylinder thimble sleeve 24 and the outer side of the top end of the sealing cover 22. The sealing cover circular sealing groove ring 25 matches with the device cover circular sealing ridge ring 13. The bottom end of the sealing cover central cylinder thimble sleeve 24 is muff-coupled with a top end of a cylindrical positioning ridge ring 38 inside the container body 35 which is provided on a bottom of a container body 35. A sealing cover bottom inner screw thread 27 is provided on the inner side of the bottom end of the sealing cover 22, for screwing with a screwing head outer screw thread 31 on an outer side of a screwing head 30 which is provided on the central portion of the container cover having a concave central portion 29. The sealing cover closing ring having a handle 28 are provided under the sealing cover bottom inner screw thread 27.

The container structure comprises: The container cover having a concave central portion 29 and a container body 35. A central concave structure of the container cover having a concave central portion 29 can receive the spouting drink into the air via the device cover drink nozzle 12 and then falling back therein. The screwing head 30 is provided in a deepest position of the container cover having a concave central portion 29. The screwing head outer screw thread 31 is provided on the outer side of the top end of the screwing head 30, for screwing with the sealing cover bottom inner screw thread 27. A screwing ring 32 of the container cover having a concave central portion 29 is provided at a screwing joint of the container cover having a concave central portion 29 and the container body 35. A screwing ring inner screw thread 33 is provided on an inner side of a screwing ring 32. A closing ring having a handle of the container cover having a concave central portion 29 are provided in a bottom end of the screwing ring 32.

A container opening 36 of the container body 35 is provided at a screwing joint of the container body 35 and the container cover having a concave central portion 29. A container opening outer screw thread 37 is provided on an outer side of the container opening 36, and screws with the screwing ring inner screw thread 33 on the inner side of the screwing ring 32 with screw thread. The cylindrical positioning ridge ring 38 inside the container body 35 is provided on the central portion of the bottom of the container body 35. The cylindrical positioning ridge ring 38 has a plurality of lateral channels 39 on a bottom side thereof. A top end of the cylindrical positioning ridge ring 38 is muff-coupled with a bottom end of the sealing cover central cylinder thimble sleeve 24. A function of the cylindrical positioning ridge ring 38 is to stabilize the whole control device and the container structure.

Referring to FIGS. 27-41, according to a preferred embodiment of the present invention, the moistureproof cover 1 comprises:

a switch handle 50;

a switch handle central cylinder 51, provided on a middle of the switch handle 50, having: chamber 53 provided in a bottom thereof, a chamber screw thread 54 provided on an inner wall of the chamber 53 for screwing up with the device cover 4, a transverse channel 55 passing through the switch handle central cylinder 51 transversely, a moistureproof cover drink channel 52 passing through the switch handle central cylinder 51 from top to the chamber 53; and a switch trigger 56, movably provided in the transverse channel 55, and having a switch trigger drink channel 57 passing through from top to bottom, wherein when the switch trigger 56 is in an opening position, the switch trigger drink channel 57 communicated with the moistureproof cover drink channel 52, when the switch trigger 56 is in a closing position, the switch trigger drink channel 57 isolated from the moistureproof cover drink channel 52.

With the foregoing structure, the spouting of the drink can be controlled conveniently by the switch trigger 56. To stop the spouting of the drink, the switch trigger 56 is moved transversely, so as to block the moistureproof cover drink channel 52.

The moistureproof cover 1 further comprises a cup 58 provided on a top of the switch handle central cylinder 51, which has a bottom communicated with the moistureproof cover drink channel 52.

With the foregoing structure, the drink is spouting inside the cup to avoid waste and provide joy and pleasure. Meanwhile, with the switch trigger 56, the drink can be enjoyed for several times.

Second Preferred Embodiment

Figure 15:
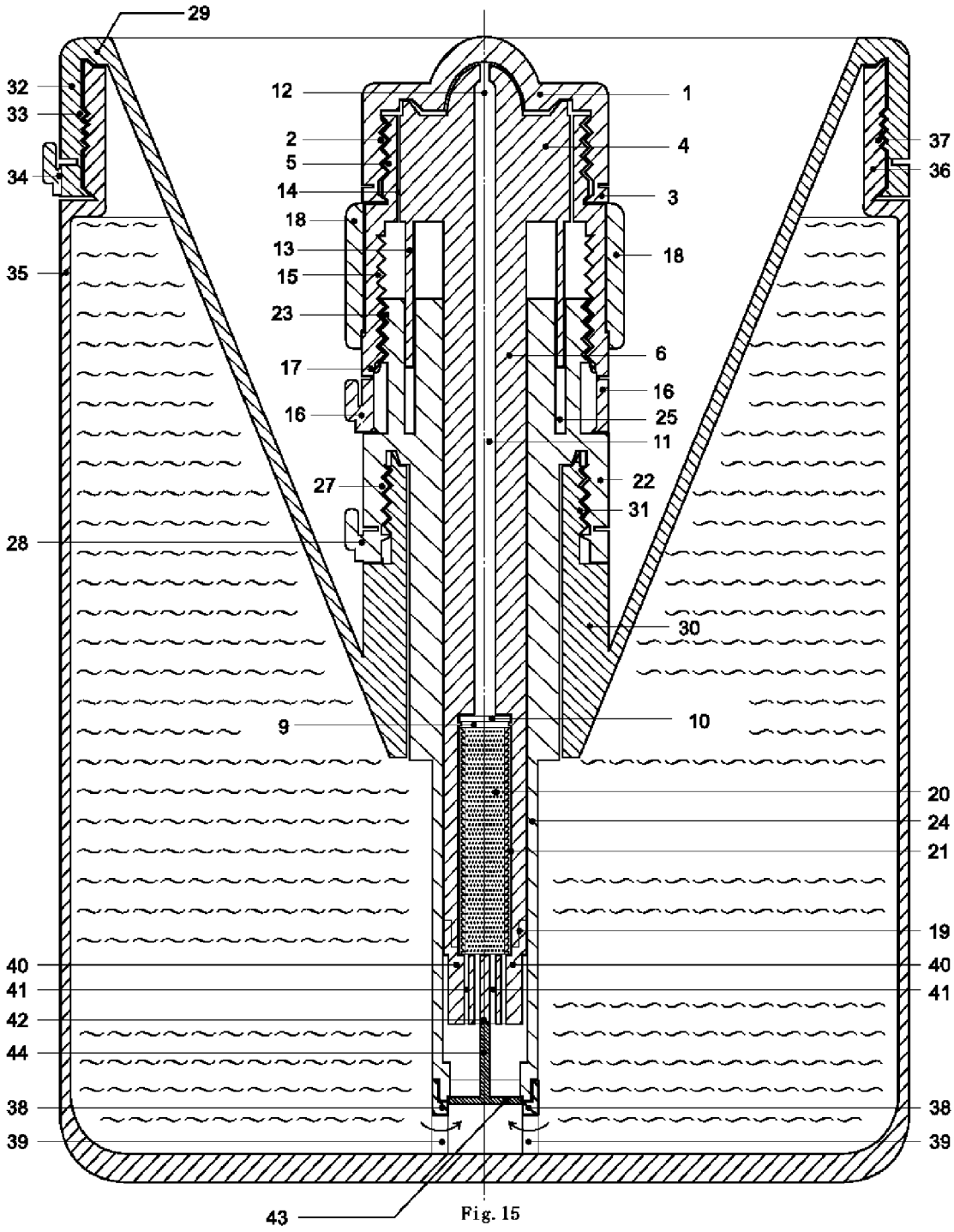
FIG. 15 is an A-A sectional view in FIG. 2 according to a second preferred embodiment of the present invention.
Figure 16:
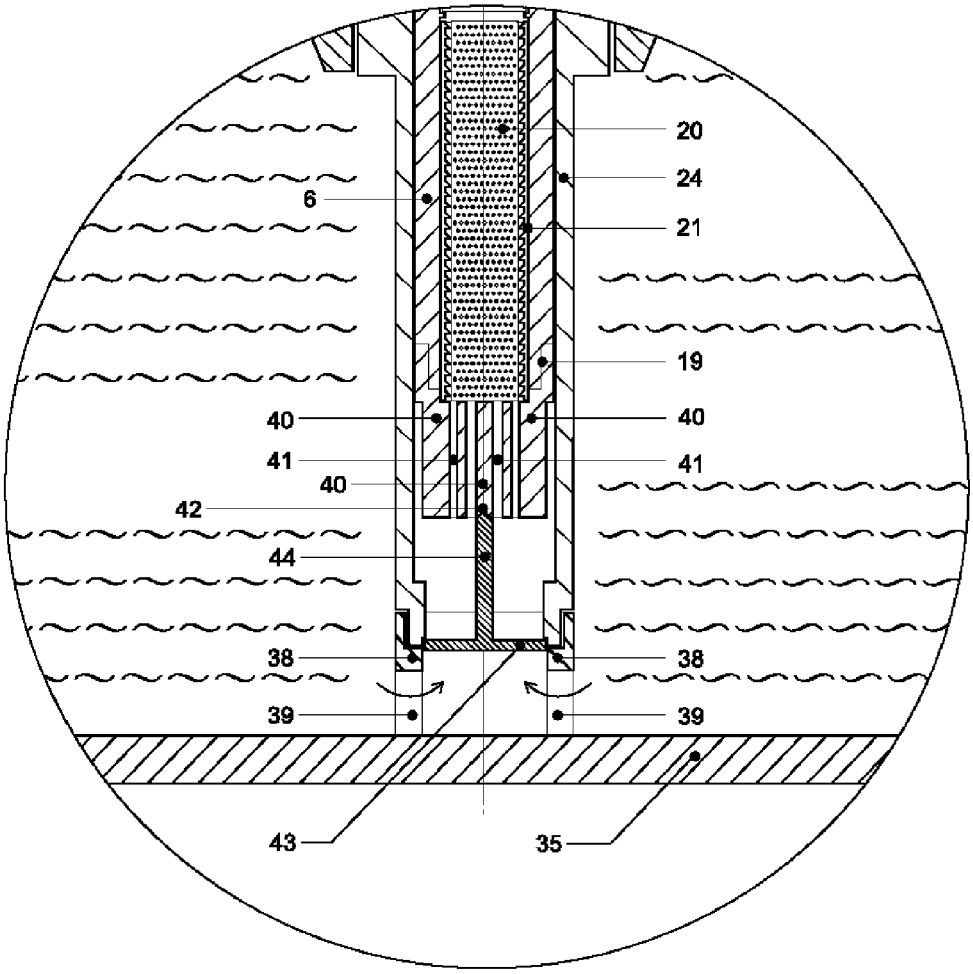
FIG. 16 is a partial enlarge view of FIG. 15.

Referring to FIGS. 15 and 16, the coniform film sealing layer having the fragile groove 26 and the device cover opening thimble 7 are replaced by a device cover crew-cut piston thimble 40 and a piston 43. The device cover crew-cut piston thimble 40 has a top end muff-coupled with the bottom end of the device cover central cylinder 6 via the muff-coupling socket 19. A puddle 42 is provided on a center of a bottom end of the device cover crew-cut piston thimble 40, and matches with a top end of a piston push rod 44. The device cover crew-cut piston thimble 40 has a plurality of the device cover crew-cut piston thimble drink channels 41 through from top to bottom. Each of the device cover crew-cut piston thimble drink channels 41 has a top opening communicated with the device cover chamber 9 provided in the bottom end of the device cover central cylinder 6.

by opening the moistureproof cover 1 on very top, and pulling the handle 16 and screwing down the device cover 4, the device cover crew-cut piston thimble 40 pushes the piston 43 to a lower limit, the drink inside the container body 35 flows into the bottom of the device cover chamber 9 provided inside the device cover central cylinder 6 and having the effervescent decomposed plug 20 positioned therein via the lateral channel 39 and the device cover crew-cut piston thimble drink channel 41, contacts and has continuous effervescent decomposed reaction with the effervescent decomposed plug 20, so as to decompose the effervescent decomposed plug 20 into $CO_2$ gas and liquid from bottom to top, wherein after the effervescent decomposed plug 20 is totally decomposed, the drink inside the container body 35 flows into the device cover chamber 9 via the lateral channel 39 and the device cover crew-cut piston thimble drink channel 41 under pressure, and then spouts out of the container via the device cover central cylinder drink channel 11 communicated with the device cover chamber 9 and the device cover drink nozzle 12 at a high speed.

Third Preferred Embodiment

Figure 17:
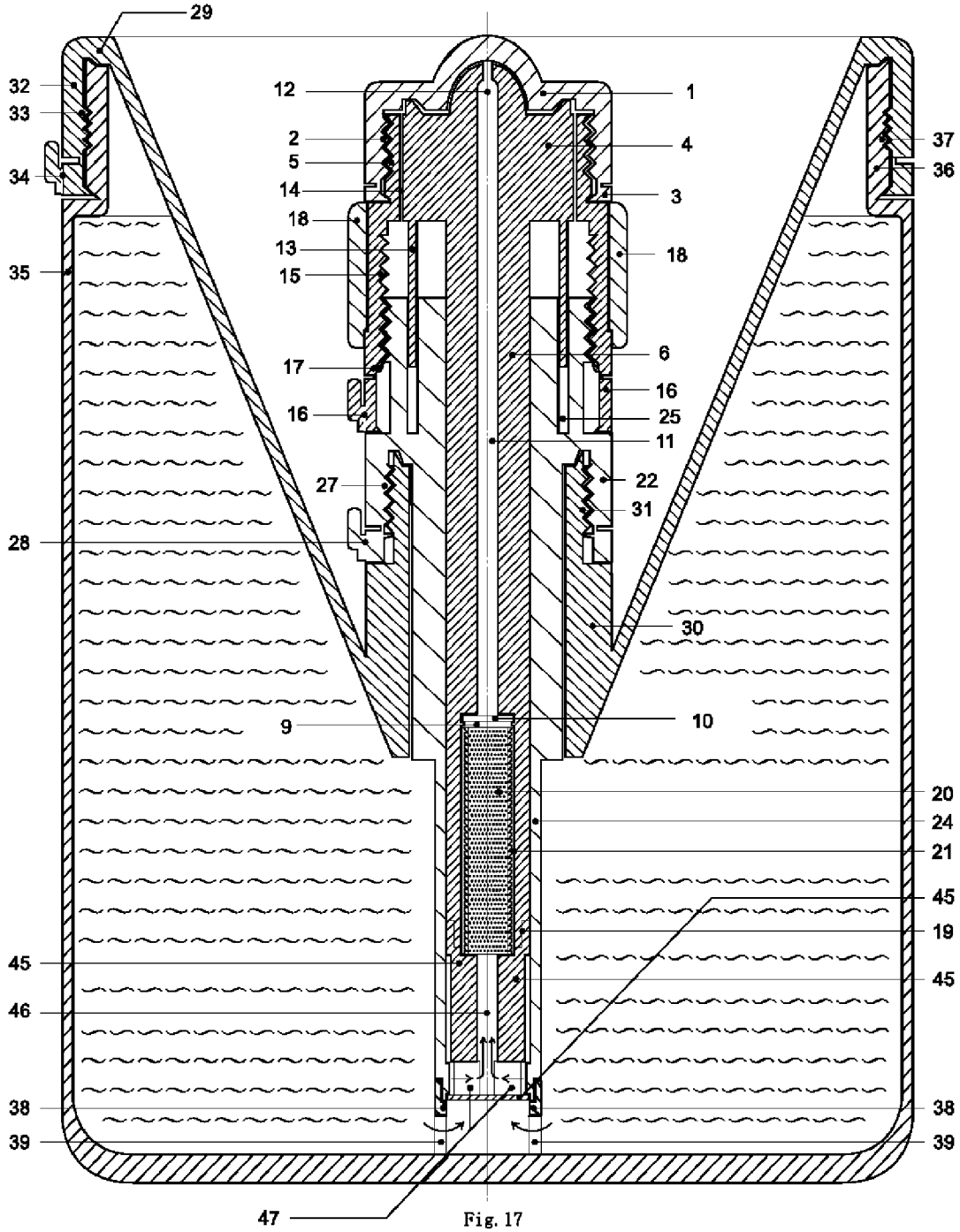
FIG. 17 is an A-A sectional view in FIG. 2 according to a third preferred embodiment of the present invention.
Figure 18:
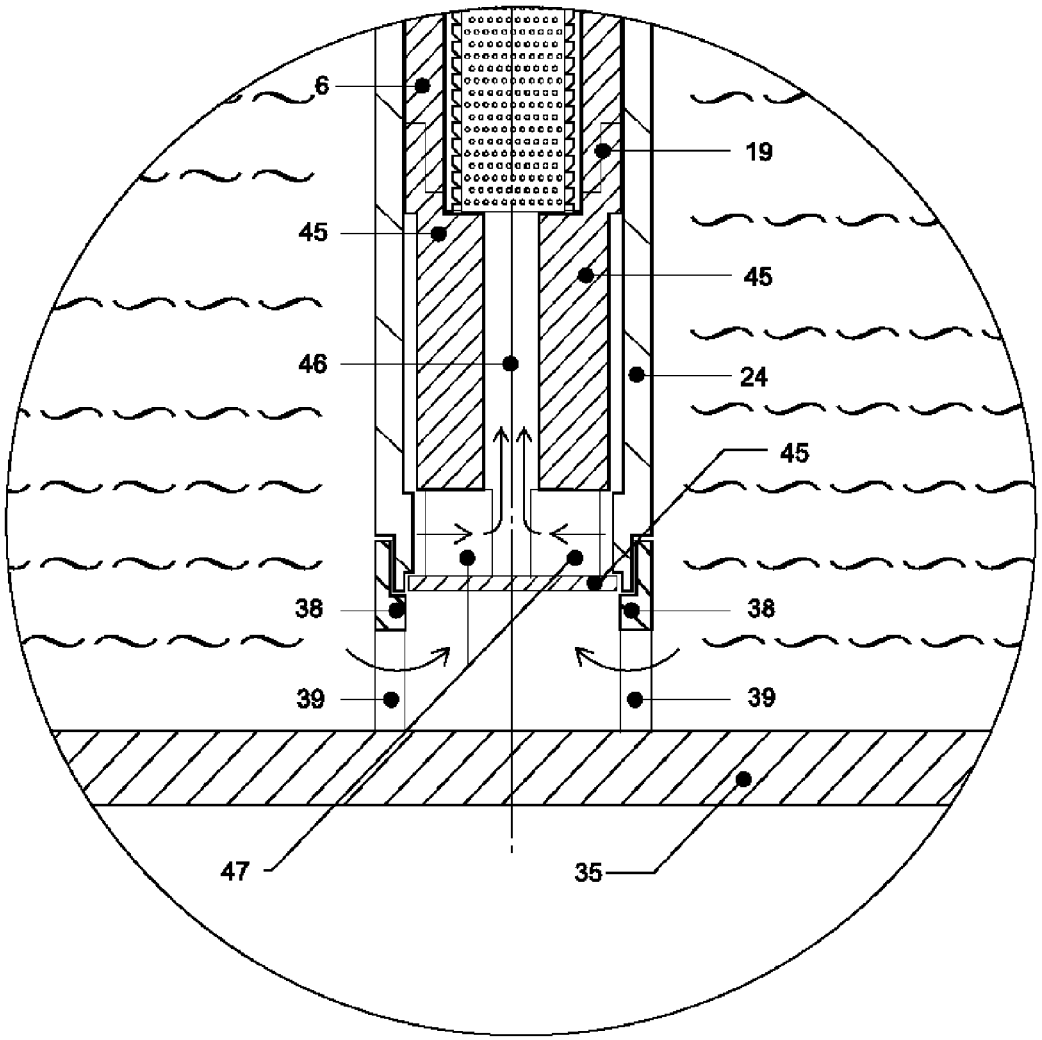
FIG. 18 is a partial enlarge view of FIG. 17.

Referring to FIGS. 17 and 18, the coniform film sealing layer having the fragile groove 26 and the device cover opening thimble 7 are replaced by a device cover crew-cut opening head 45. The device cover crew-cut opening head 45 has a top end muff-coupled with the bottom end of the device cover central cylinder 6 via the muff-coupling socket 19. A device cover crew-cut opening head drink channel 46 is provided within the device cover crew-cut opening head 45, and has a top opening communicated with the device cover chamber 9 provided in the bottom end of the device cover central cylinder 6, and a bottom opening communicated with a lateral hole 47 on a bottom side of the device cover crew-cut opening head 45.

by opening the moistureproof cover 1 on very top, and pulling the handle 16 and screwing down the device cover 4, the device cover crew-cut opening head 45 is pushed to a lower limit, the drink inside the container body 35 flows into the bottom of the device cover chamber 9 provided inside the device cover central cylinder 6 and having the effervescent decomposed plug 20 positioned therein via the lateral channel 39, the lateral hole 47, and the device cover crew-cut opening head drink channel, contacts and has continuous effervescent decomposed reaction with the effervescent decomposed plug 20, so as to decompose the effervescent decomposed plug 20 into $CO_2$ gas and liquid from bottom to top, wherein after the effervescent decomposed plug 20 is totally decomposed, the drink inside the container body 35 flows into the device cover chamber 9 via the lateral channel 39, the lateral hole 47, and the device cover crew-cut opening head drink channel under pressure, and then spouts out of the container via the device cover central cylinder drink channel 11 communicated with the device cover chamber 9 and the device cover drink nozzle 12 at a high speed.

Fourth Preferred Embodiment

Figure 19:
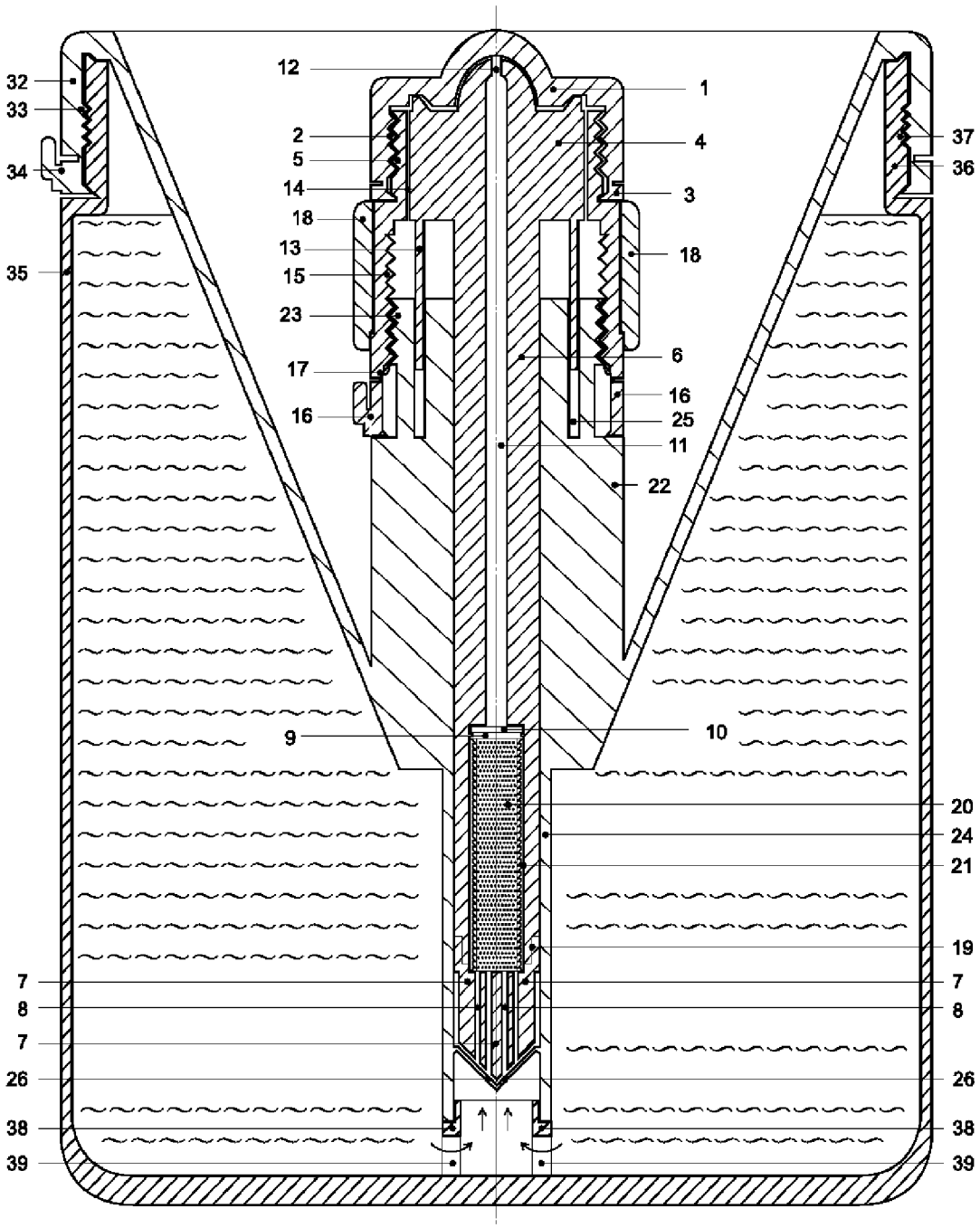
FIG. 19 is an A-A sectional view in FIG. 2 according to a fourth preferred embodiment of the present invention, wherein the container cover and the sealing cover are an integration.
Figure 20:
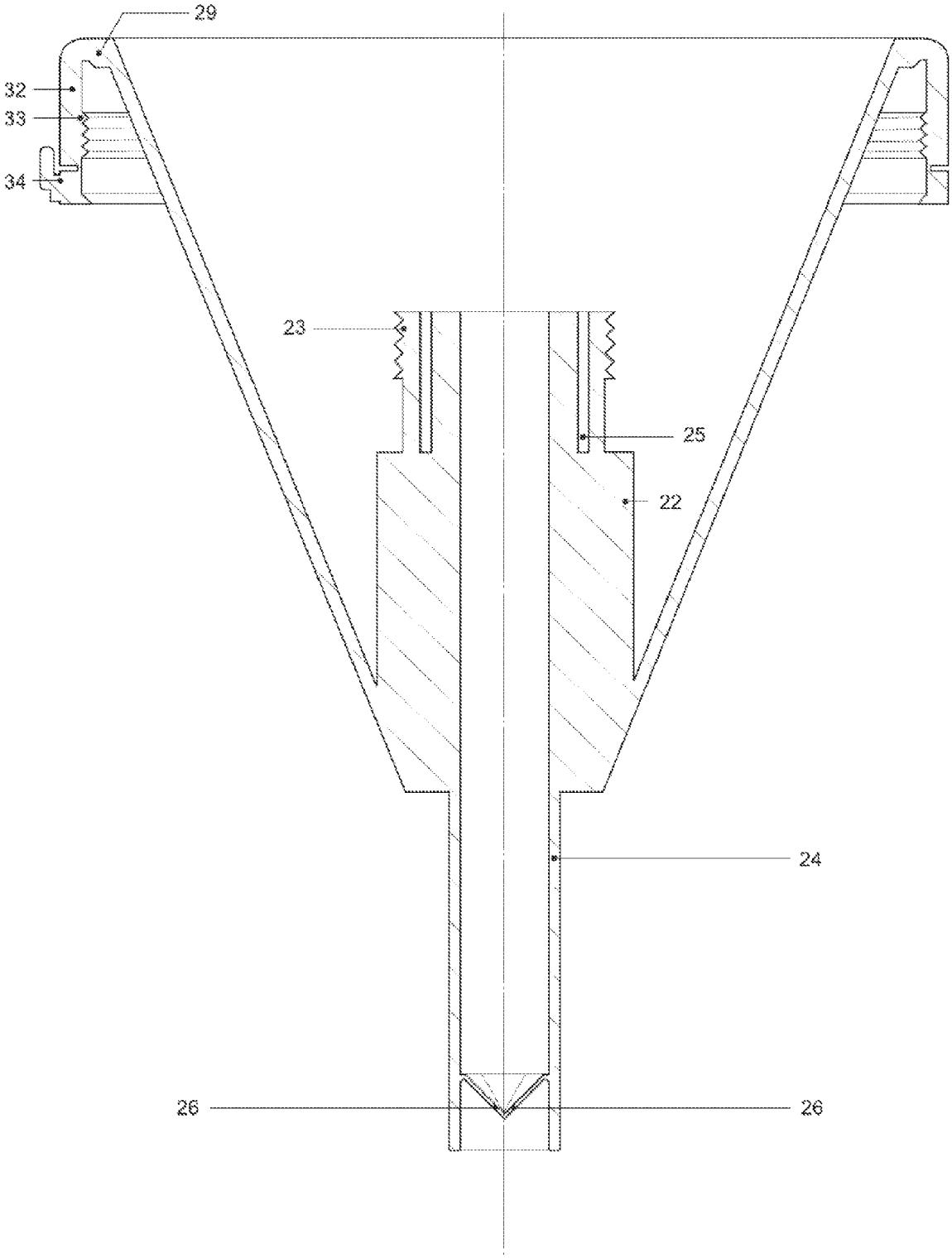
FIG. 20 is a sectional view of the container cover and the sealing cover which are formed integrally.

Referring to FIGS. 19 and 20, the container cover having a concave central portion 29 and the sealing cover 22 can be formed integrally, have no the sealing cover bottom inner screw thread 27, the sealing cover closing ring having a handle 28, the screwing head 30 and the screwing head outer screw thread 31 therebetween, so as to reduce the number of elements, simplify producing procedure and increase assembling efficiency.

Fifth Preferred Embodiment

Figure 21:
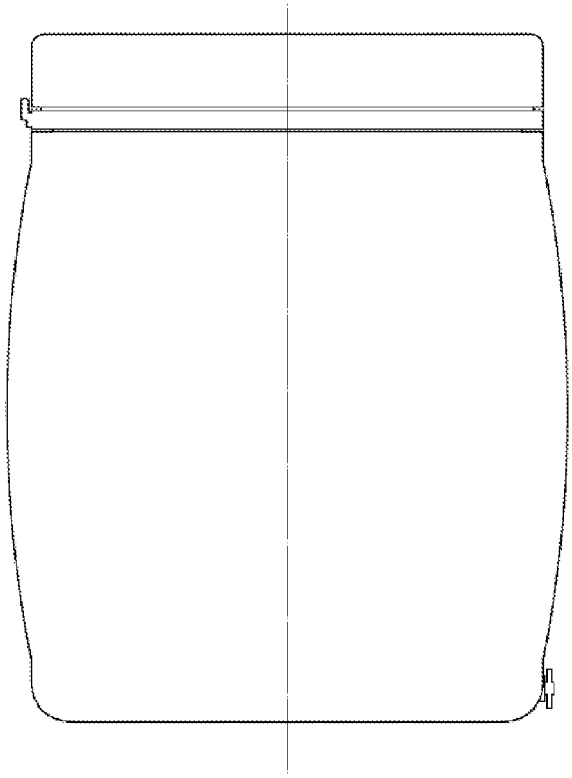
FIG. 21 is a perspective view according to a fifth preferred embodiment of the present invention, wherein the container is a barrel.
Figure 22:
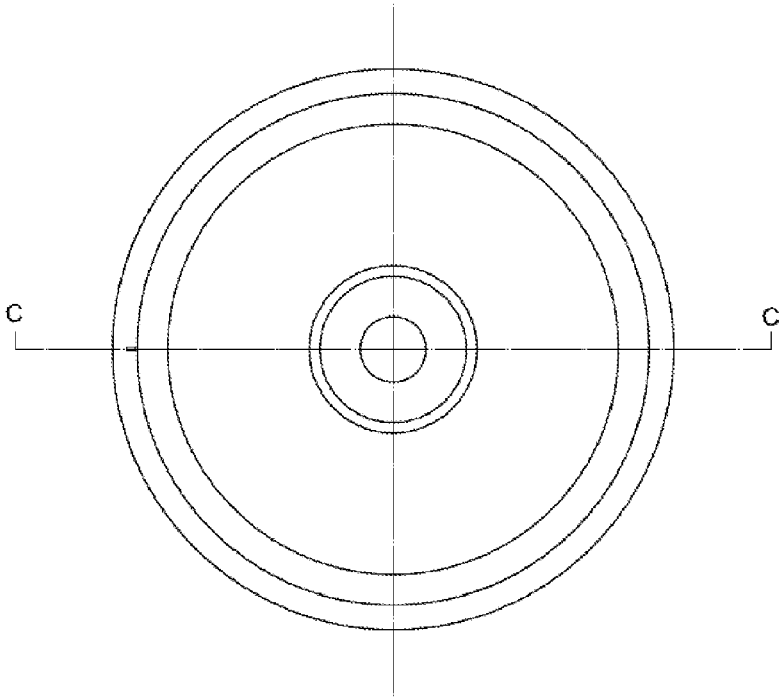
FIG. 22 is a planform view of FIG. 21.
Figure 23:
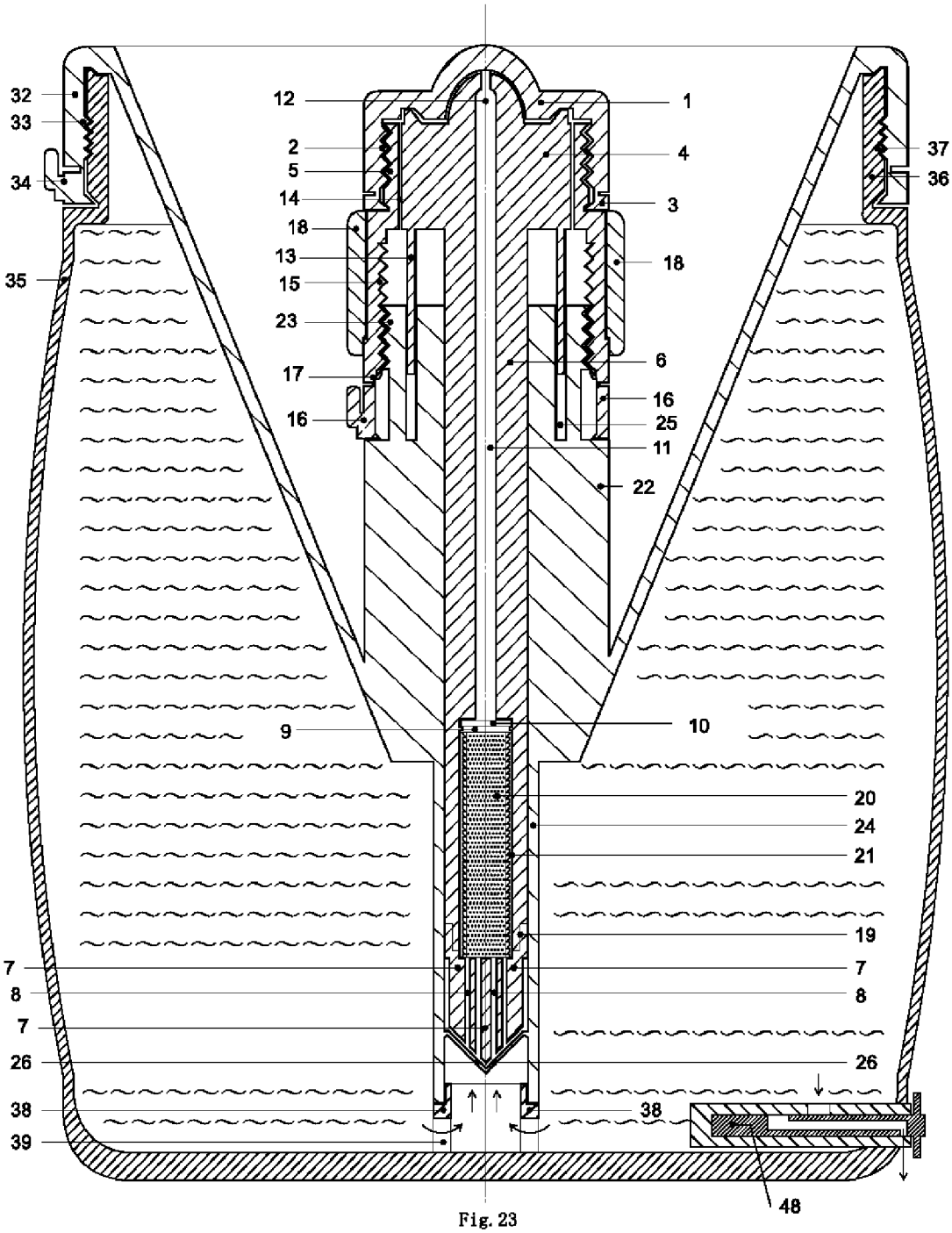
FIG. 23 is a C-C sectional view in FIG. 22.

Referring to FIGS. 21-23, the container body 35 can be a barrel having a valve 48 assembled outside a bottom thereof.

Sixth Preferred Embodiment

Figure 24:
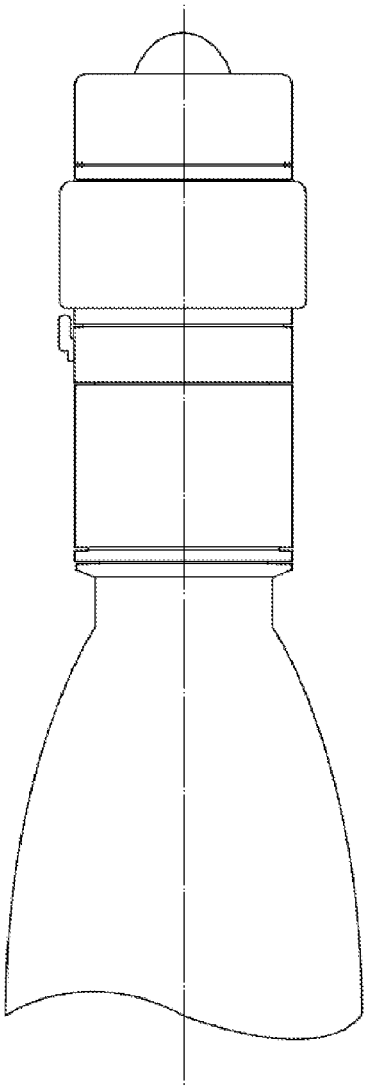
FIG. 24 is a perspective view according to a sixth preferred embodiment of the present invention, wherein the control device screws with a conventional drink container having an opening of screw thread.
Figure 25:
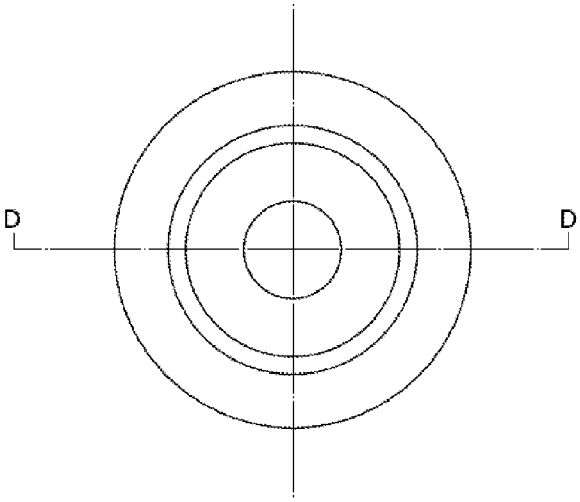
FIG. 25 is a planform view of FIG. 24.
Figure 26:
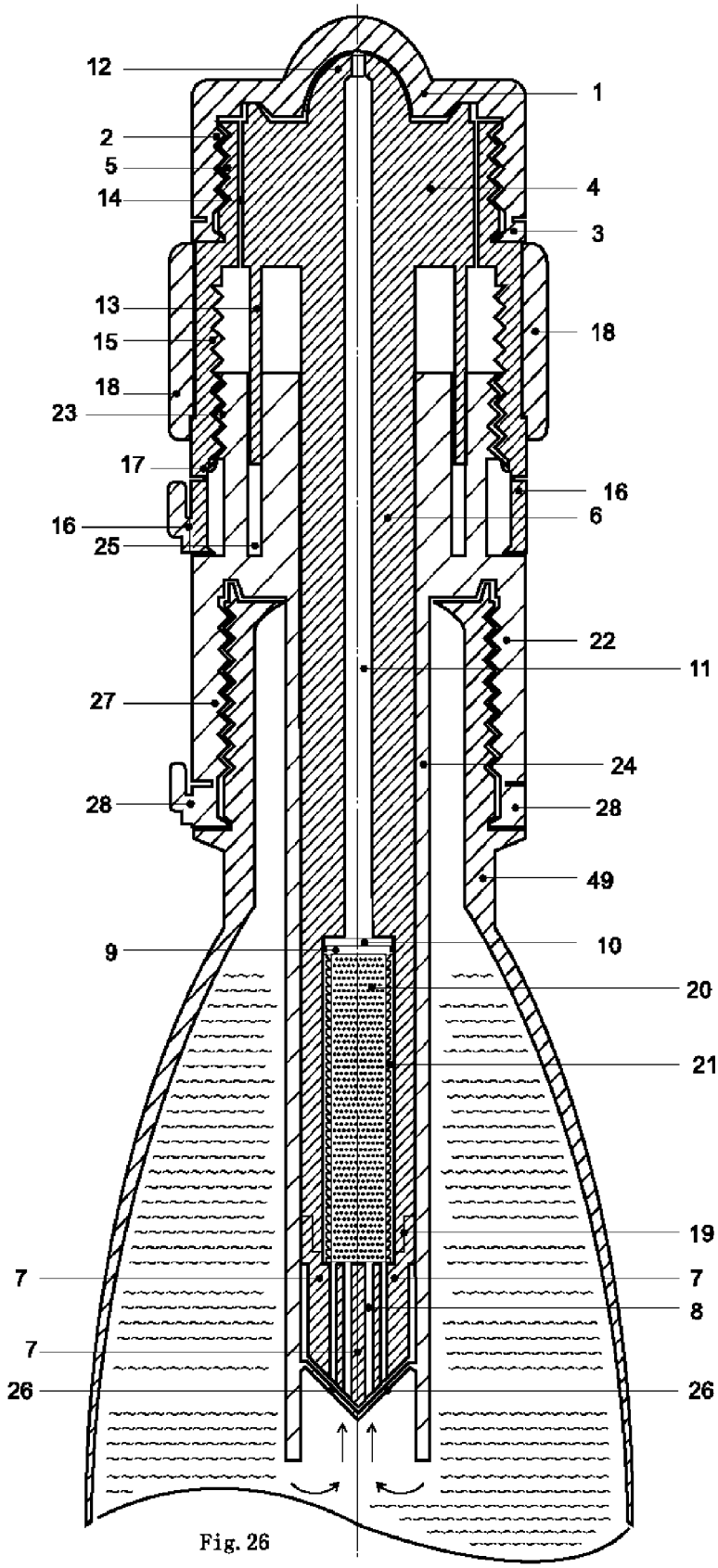
FIG. 26 is a D-D sectional view in FIG. 25.
Figure 31:
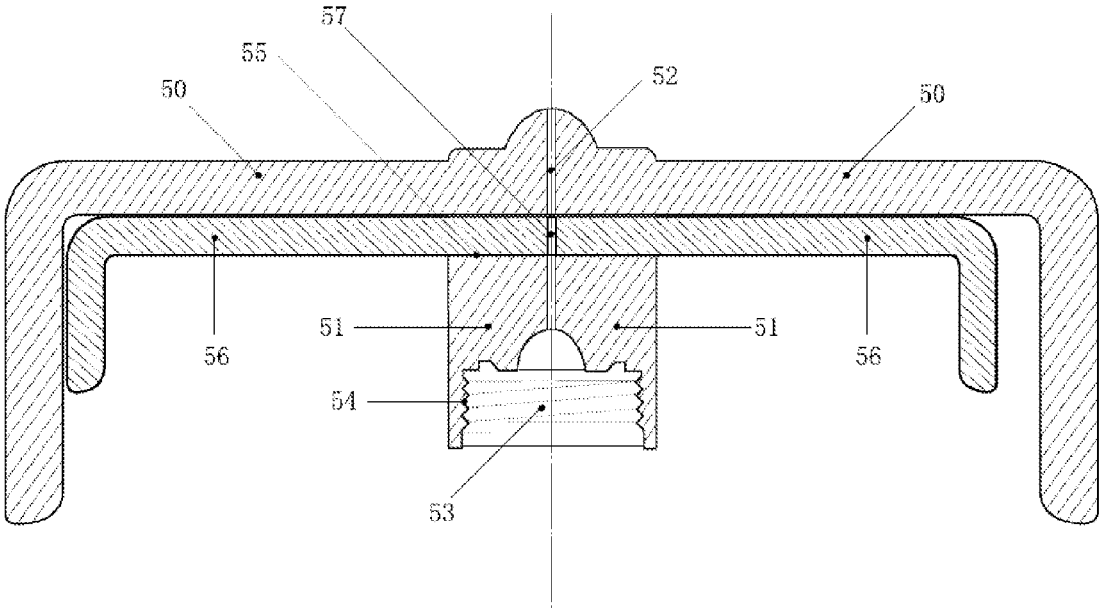
FIG. 31 is an E-E sectional view in FIG. 28.
Figure 32:
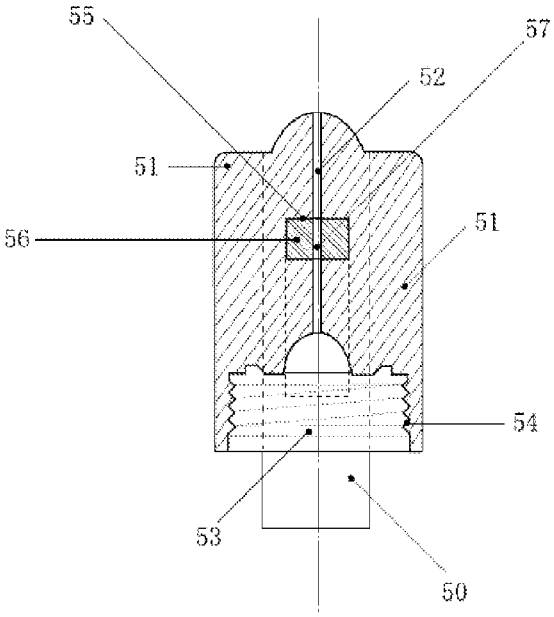
FIG. 32 is an F-F sectional view in FIG. 28.
Figure 33:
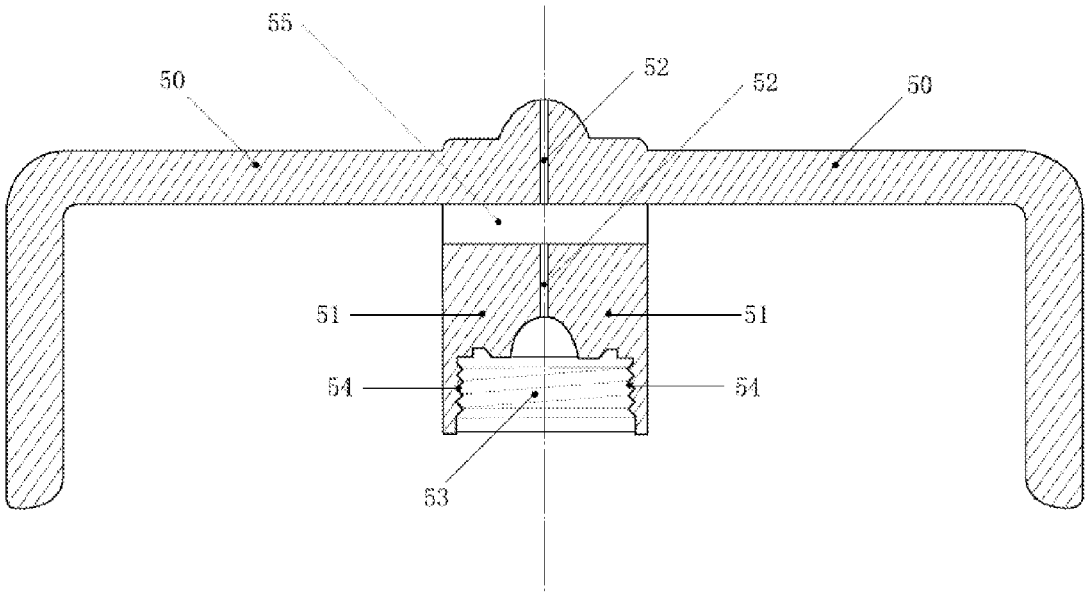
FIG. 33 is a sketch view of the switch handle without a switch trigger in FIG. 31.
Figure 34:
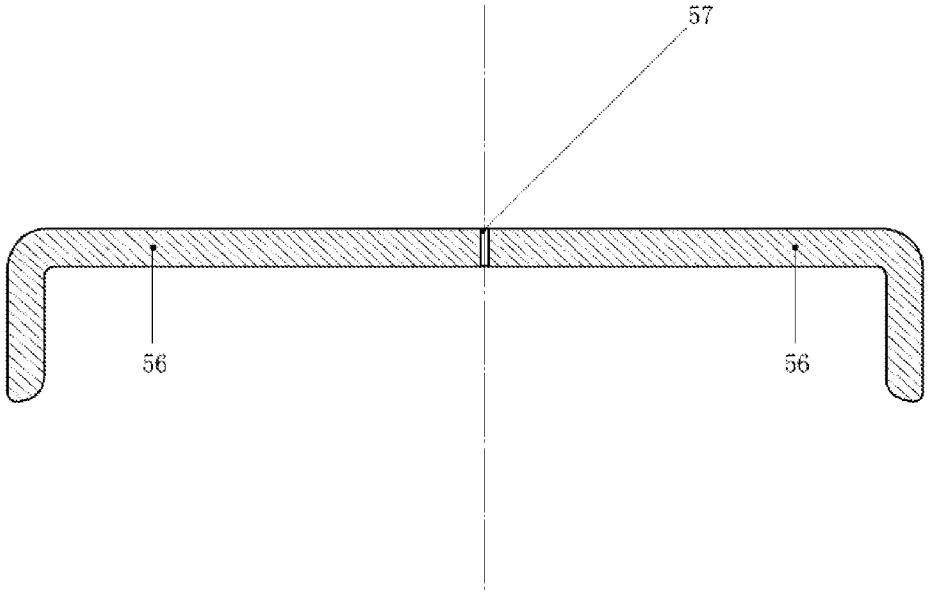
FIG. 34 is a sketch view of the switch trigger in FIG. 31.
Figure 35:
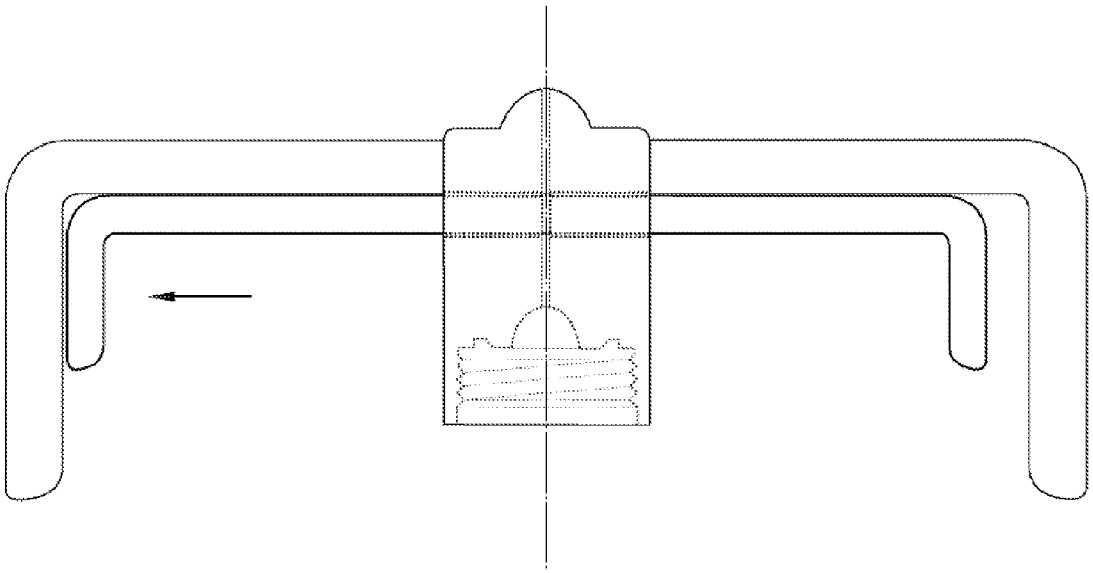
FIG. 35 is a sketch view of a position of the switch trigger in a status when drink can spout out.
Figure 36:
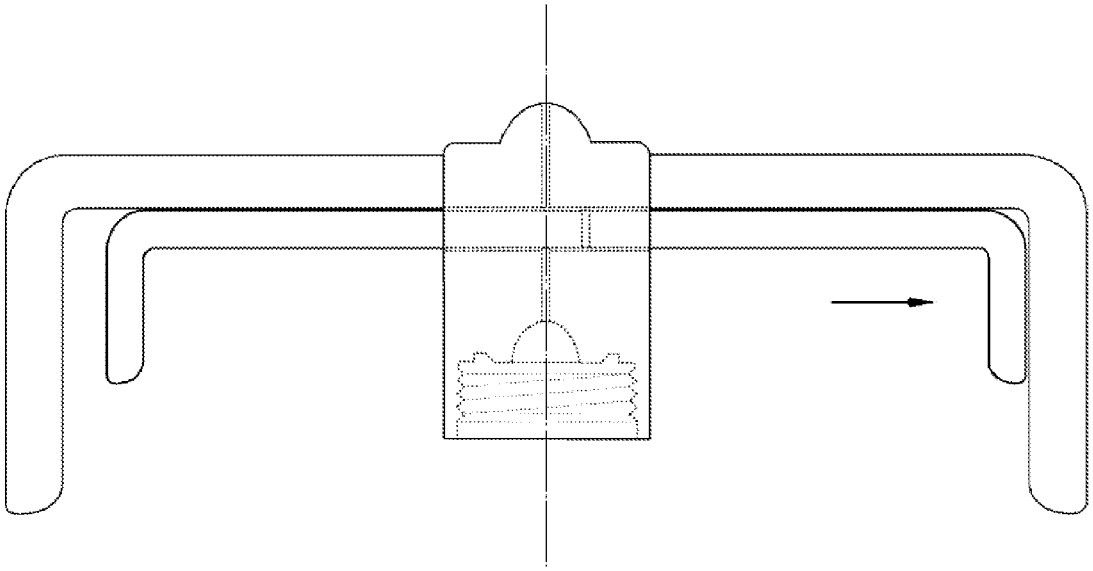
FIG. 36 is a sketch view of a position of the switch trigger in a status when the drink cannot spout out.
Figure 37:
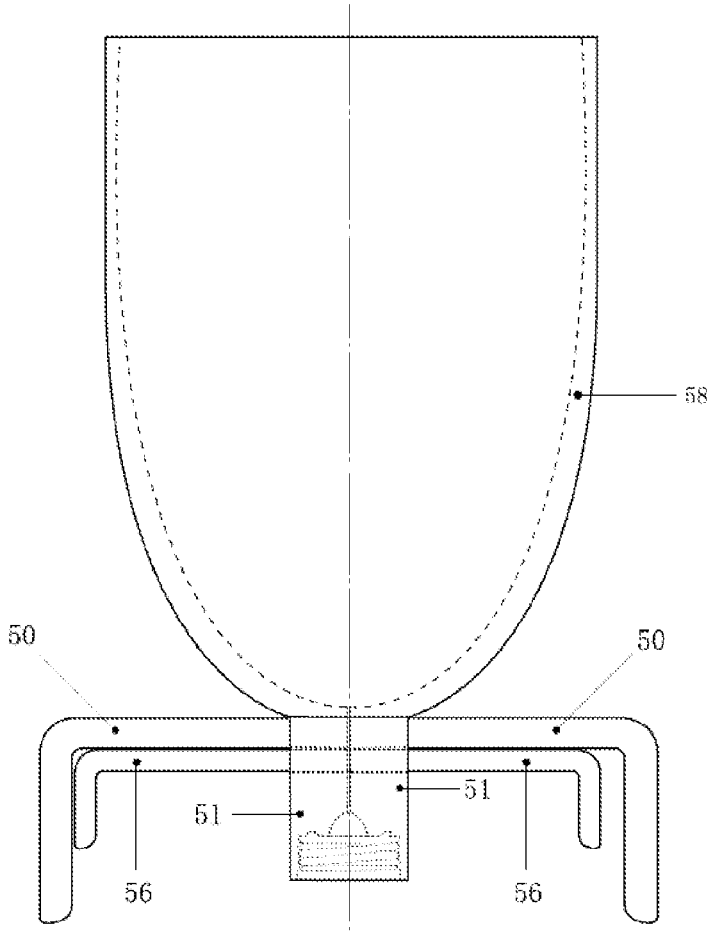
FIG. 37 is a front view of a switch handle with a cup.
Figure 38:
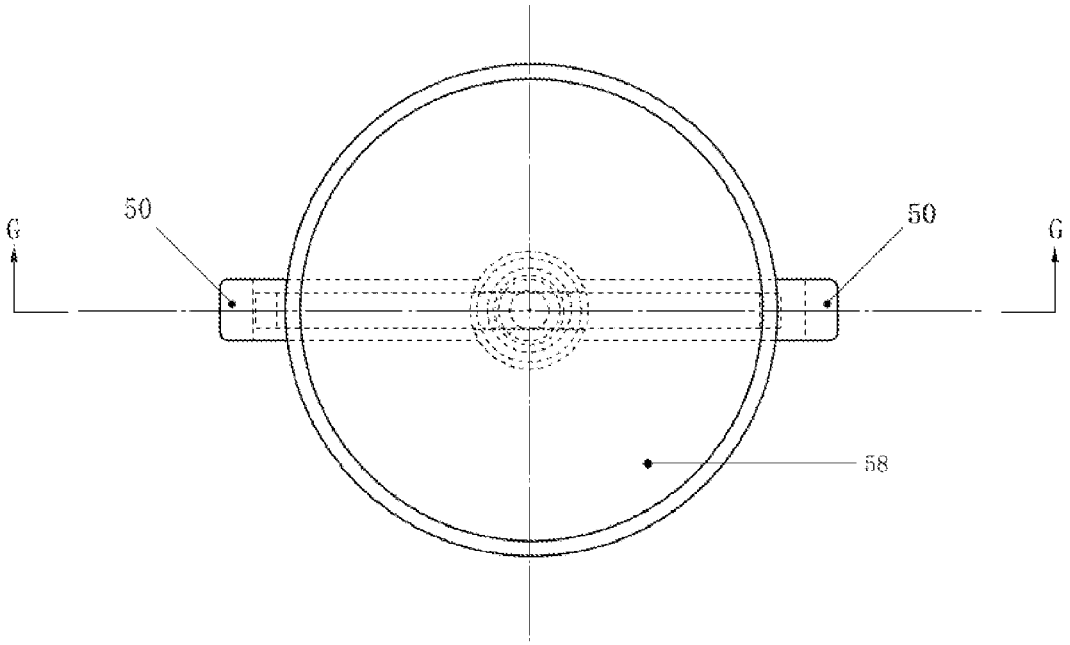
FIG. 38 is a planform view of the switch handle with the cup.
Figure 39:
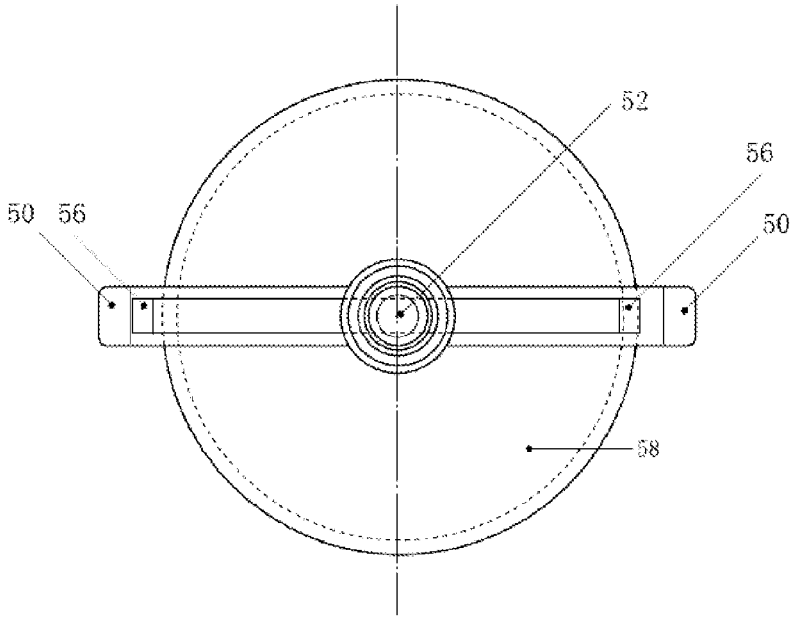
FIG. 39 is a bottom view of the switch handle with the cup.
Figure 40:
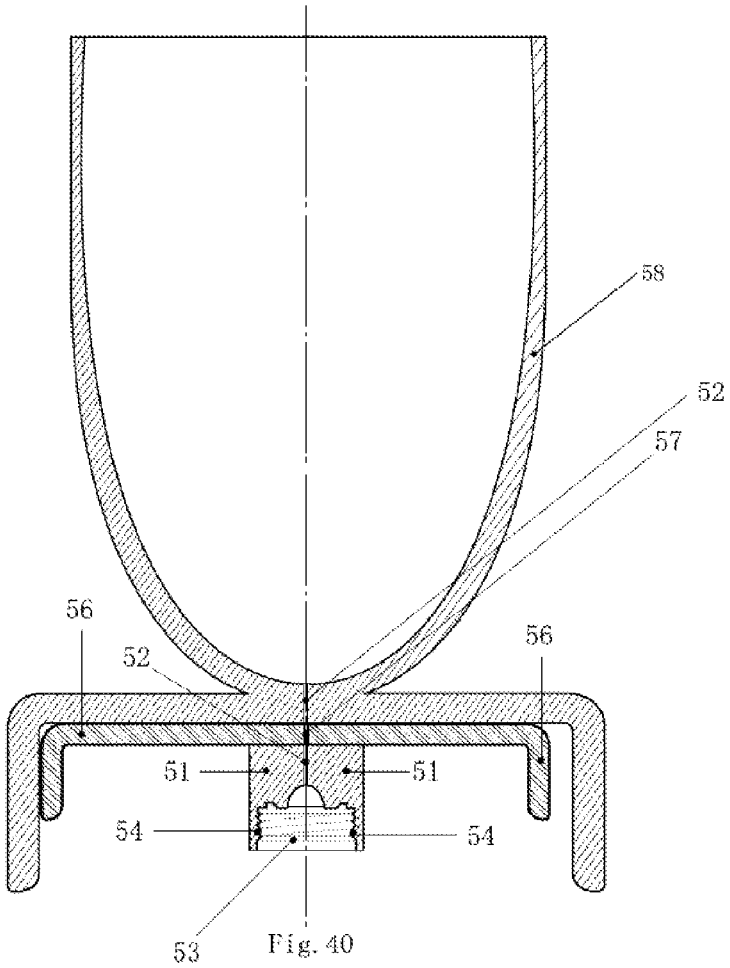
FIG. 40 is a G-G sectional view in FIG. 38.
Figure 41:
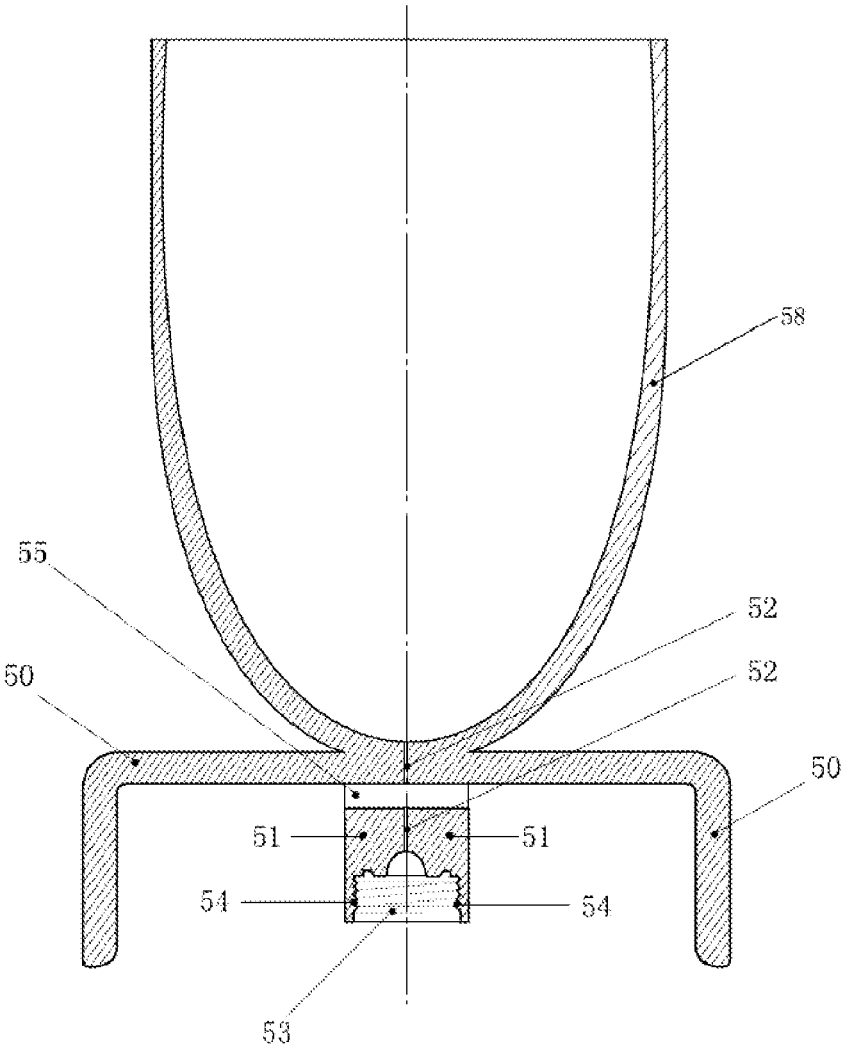
FIG. 41 is a sketch view of the switch handle with the cup and without a switch trigger in FIG. 40.
Figure 42:
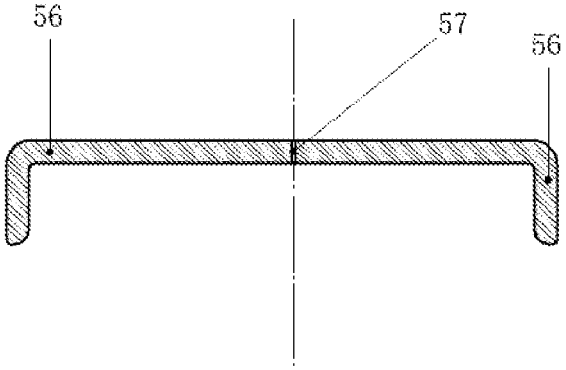
FIG. 42 is a sketch view of the switch trigger with the cup in FIG. 40.

Referring to FIGS. 24-26, the container body 35 can be a conventional drink container having an opening of screw thread 49.

Operation and Control Procedure

The user first places the drink container on a table or in the left hand, unscrews and removes the moistureproof cover 1, and then the moistureproof cover closing ring 3 under the moistureproof cover 1 will be torn from the moistureproof cover 1. Remove the moistureproof cover 1, hold the handle of the device cover closing ring having a handle 16 and tear out the device cover closing ring having a handle 16. Hold the device cover screwing sleeve 18 outside the device cover 4, screw down the device cover 4 to the lower limit, and then remove the device cover screwing sleeve 18.

Accordingly, the device cover opening thimble 7, which has been screwed to the lower limit, breaks the coniform film sealing layer having the fragile groove 26. The drink inside the container body 35 flows into the bottom of the device cover chamber 9 via the lateral channel 39 and the device cover opening thimble drink channel 8, contacts and has continuous effervescent decomposed reaction with the effervescent decomposed plug 20, so as to decompose the effervescent decomposed plug 20 into $CO_2$ gas and liquid from bottom to top, wherein after the effervescent decomposed plug 20 is totally decomposed, the drink inside the container body 35 flows into the device cover chamber 9 via the lateral channel 39 and the device cover opening thimble drink channel 8 under pressure, and then spouts out of the container via the device cover central cylinder drink channel 11 communicated with the device cover chamber 9 and the device cover drink nozzle 12 at a high speed.

The spouting drink to the air will fall back into the central concave structure of the container cover having a concave central portion 29 after reaching the apogee. And the drink will stop spouting when the pressure is balanced inside and outside the container, and the spouting drink to the air falls back into the central concave structure of the container cover having a concave central portion 29.

Now the user can enjoy the drink falling back in two ways. The first way is picking up the container directly and drinking from an edge of the container cover having a concave central portion 29, just like ordinary cups, which is adapted for enjoying the drink alone. The second way is pouring the drink falling back into other cups to share, which is adapted for enjoying the drink with others.

It is worth mentioning that, either in the first or the second way, the moistureproof cover 1 should be screwed up to the device cover 4 again before pouring the drink into other cups, so as to prevent the drink from flowing out from the device cover drink nozzle 12 when pouring or drinking the drink. After drinking up the drink falling back, the user also has two choices for the rest drink. The first choice is sucking from the device cover drink nozzle 12 directly, and the second choice is holding the handle of the closing ring having a handle of the container cover having the concave central portion 34, tearing the closing ring having a handle of the container cover having the concave central portion 34, unscrewing and removing the container cover having a concave central portion 29 and drinking from the edge of the container, like ordinary cups, which is adapted for enjoying the drink alone. If several people share the drink, the drink can be poured out to other cups.

When the container cover having a concave central portion 29 and the sealing cover 22 is formed integrally, the above operation and control procedure do not change.

When the coniform film sealing layer having the fragile groove 26 and the device cover opening thimble 7 are replaced by the device cover crew-cut piston thimble 40 and the piston 43, the above operation and control procedure do not change.

When the coniform film sealing layer having the fragile groove 26 and the device cover opening thimble 7 are replaced by the device cover crew-cut opening head 45, the above operation and control procedure do not change.

When the screen 10 and the device cover 4 are formed integrally, the above operation and control procedure do not change.

When the multi-layers annular ridge sealing sleeve 21 and the device cover 4 are formed integrally, the above operation and control procedure do not change.

When the container is a barrel having a valve assembled outside a bottom thereof, the goods of this package are ordinarily liquor of 5 liter, especially beer, champagne, foam liquor, or carbonated drinks containing gas. The user should place the container on the table, unscrew and remove the moistureproof cover 1, and then the moistureproof cover closing ring 3 under the moistureproof cover 1 will be torn from the moistureproof cover 1. Remove the moistureproof cover 1, hold the handle of the device cover closing ring having a handle 16 and tear out the device cover closing ring having a handle 16. Hold the device cover screwing sleeve 18 outside the device cover 4, screw down the device cover 4 to the lower limit, and then remove the device cover screwing sleeve 18.

Accordingly, the device cover opening thimble 7, which has been screwed to the lower limit, evenly breaks the coniform film sealing layer having the fragile groove 26. The drink inside the container body 35 flows into the bottom of the device cover chamber 9 via the lateral channel 39 and the device cover opening thimble drink channel 8, contacts and has continuous effervescent decomposed reaction with the effervescent decomposed plug 20, so as to decompose the effervescent decomposed plug 20 into $CO_2$ gas and liquid from bottom to top, wherein after the effervescent decomposed plug 20 is totally decomposed, the drink inside the container body 35 flows into the device cover chamber 9 via the lateral channel 39 and the device cover opening thimble drink channel 8 under pressure, and then spouts out of the container via the device cover central cylinder drink channel 11 communicated with the device cover chamber 9 and the device cover drink nozzle 12 at a high speed.

The spouting drink to the air will fall back into the central concave structure of the container cover having a concave central portion 29 after reaching the apogee. And the drink will stop spouting when the pressure is balanced inside and outside the container, and the spouting drink to the air falls back into the central concave structure of the container cover having a concave central portion 29. The moistureproof cover 1 should be screwed up to the device cover 4 before pouring the drink into other cups, so as to prevent the drink from flowing out from the device cover drink nozzle 12 when pouring the drink into other cups. After pouring the drink falling back, the user can open the valve to let out the liquor or drink in the container into other cups to share.

When the container is the conventional drink container having an opening of screw thread 49, it is a special operation manner. In some circumstances, the users do not want to collect the spouting drink out, they only need the spouting manner and joy effect. A preferred drink is carbonated drink.

The user unscrews and removes the moistureproof cover 1, wherein the moistureproof cover closing ring 3 under the moistureproof cover 1 will be torn from the moistureproof cover 1, and then removes the moistureproof cover 1. After the user holds the handle of the device cover closing ring having a handle 16 and tear out the device cover closing ring having a handle 16, for better spouting effect, the user can shake the container acutely, so that $CO_2$ in the carbonated drink releases within the container as much as possible to increase pressure inside the container. Afterwards, the user can hold the device cover screwing sleeve 18 outside the device cover 4, screw down the device cover 4 to the lower limit, and then remove the device cover screwing sleeve 18.

Accordingly, the device cover opening thimble 7, which has been screwed to the lower limit, evenly breaks the coniform film sealing layer having the fragile groove 26. The drink inside the container body 35 flows into the bottom of the device cover chamber 9 via the device cover opening thimble drink channel 8, contacts and has continuous effervescent decomposed reaction with the effervescent decomposed plug 20, so as to decompose the effervescent decomposed plug 20 into $CO_2$ gas and liquid from bottom to top, wherein after the effervescent decomposed plug 20 is totally decomposed, the drink inside the container body 35 flows into the device cover chamber 9 via the device cover opening thimble drink channel 8 under pressure, and then spouts out of the container via the device cover central cylinder drink channel 11 communicated with the device cover chamber 9 and the device cover drink nozzle 12 at a high speed. The drink stops spouting when the pressure is balanced inside and outside the container. After spouting drink stops, if the user wants to drink the rest drink in the container, the user can drink from the device cover drink nozzle 12 directly, and can also drink from the container opening 36 by unscrewing the sealing cover 22 and removing the entire control device of spouting drink.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A container for spouting drink which contains gas, comprising:

a container structure comprising container body for containing the drink, wherein said container body has a container opening; and a control device, comprising: a drink-decomposed plug provided on said container opening for blocking said container opening, which is capable of being decomposed by the drink, a blocking element positioned inside said container body, for preventing said drink-decomposed plug from contacting with the drink, and a triggering element for disabling said blocking element, wherein when said triggering element disables said blocking element, the drink contacts with said drink-decomposed plug and starts decomposing said drink-decomposed plug, and after said drink-decomposed plug is completely decomposed, the drink spouts out of said container body, wherein the container further comprises:

a device cover;

a device cover central cylinder provided on a central portion of said device cover, wherein said device cover central cylinder has a device cover central cylinder drink channel and a device cover chamber, said device cover central cylinder drink channel is on an upper portion thereof, and said device cover chamber is on a lower portion thereof, wherein a top end of said device cover central cylinder drink channel has an opening on a top of said device cover central cylinder, and a bottom end communicated through an top end of said device cover chamber, wherein said drink-decomposed plug is positioned inside said device cover chamber for blocking said device cover central cylinder drink channel; and a sealing cover central cylinder thimble sleeve, wherein a bottom end of said device cover chamber has an opening on a bottom of said device cover central cylinder, an outer diameter of said device cover central cylinder is equal to an inner diameter of said sealing cover central cylinder thimble sleeve, said device cover central cylinder is sleeved inside said sealing cover central cylinder thimble sleeve, wherein said triggering element is a device cover opening thimble, said bottom of said device cover central cylinder is muff-coupled with a top end of said device cover opening thimble via a muff-coupling socket, said blocking element is a coniform film sealing layer having a fragile groove, wherein a bottom end of said device cover opening thimble is coniform and matches with said coniform film sealing layer having said fragile groove which is provided on an inner side of said bottom end of said sealing cover central cylinder thimble sleeve, wherein said device cover opening thimble has a plurality of device cover opening thimble drink channels through from top to bottom in a central portion thereof, a top end of said device cover opening thimble drink channel has an opening communicated through said device cover chamber which is provided inside said bottom end of said device cover central cylinder.

2. The container, as recited in claim 1, further comprising a device cover circular sealing ridge ring provided between said device cover central cylinder and an outer wall of said device cover, and matching with a sealing cover circular sealing groove ring, and a sealing cover, wherein a top layer of said device cover provided between said device cover circular sealing ridge ring and said outer wall of said device cover has a plurality of device cover decompressing pores through said top layer, a device cover bottom inner screw thread is provided on a screw joint of said device cover and said sealing cover, for screwing with a sealing cover top outer screw thread, a plurality of device cover locking barbs are provided on an inner side of a bottom end of said device cover bottom inner screw thread, a device cover closing ring having a handle is provided under said device cover locking barbs, a device cover screwing sleeve sleeves on an outer side of a middle portion of said device cover.

3. The container, as recited in claim 2, further comprising a moistureproof cover, wherein said moistureproof cover has a moistureproof cover inner screw thread on an inner side thereof, for screwing with an device cover top outer screw thread, a moistureproof cover closing ring is provided on a lower portion of said moistureproof cover inner screw thread, wherein a multi-layers annular ridge sealing sleeve coats firmly on said drink-decomposed plug, wherein said drink-composed plug is an effervescent decomposed plug, said effervescent decomposed plug and said multi-layers annular ridge sealing sleeve fill said device cover chamber inside said bottom end of said device cover central cylinder, wherein said sealing cover top outer screw thread is provided on said outer side of said top end of said sealing cover, for screwing with said device cover bottom inner screw thread, said sealing cover central cylinder thimble sleeve is provided on a central portion of said sealing cover, said coniform film sealing layer having said fragile groove is provided on said inner side of said bottom end of said sealing cover central cylinder thimble sleeve, said coniform film sealing layer having said fragile groove matches with said coniform bottom end of said device cover opening thimble, said sealing cover circular sealing groove ring is provided between said opening on said top end of said sealing cover central cylinder thimble sleeve and said outer side of said top end of said sealing cover, said sealing cover circular sealing groove ring matches with said device cover circular sealing ridge ring, said bottom end of said sealing cover central cylinder thimble sleeve is muff-coupled with a top end of a cylindrical positioning ridge ring which is provided on a bottom inside said container body, a sealing cover bottom inner screw thread is provided on said inner side of said bottom end of said sealing cover, for screwing with a screwing head outer screw thread on an outer side of a screwing head which is provided on a central portion of a container cover having a concave central portion, a sealing cover closing ring having a handle is provided under said sealing cover bottom inner screw thread, said screwing head is provided in a deepest position of said container cover having said concave central portion, said screwing head outer screw thread is provided on said outer side of said top end of said screwing head, for screwing with said sealing cover bottom inner screw thread, a screwing ring of said container cover having said concave central portion is provided at a screwing joint of said container cover having said concave central portion and said container body, a screwing ring inner screw thread is provided on an inner side of said screwing ring, a closing ring having a handle of said container cover having said concave central portion is provided in a bottom end of said screwing ring.

4. The container, as recited in claim 3, wherein said container opening of said container body is provided at a screwing joint of said container body and said container cover having said concave central portion, wherein a container opening outer screwing thread is provided on an outer side of said container opening, and screws with said screwing ring inner screw thread on said inner side of said screwing ring with screw thread, said cylindrical positioning ridge ring is provided on said central portion of said bottom of said container body, said cylindrical positioning ridge ring has a plurality of lateral channels on a bottom side thereof, a top end of said cylindrical positioning ridge ring is muff-coupled with a bottom end of said sealing cover central cylinder thimble sleeve.

5. The container, as recited in claim 1, wherein said drink-decomposed plug comprises an effervescent decomposed ingredient consisting of sodium bicarbonat, e citric acid or tartaric acid, an eatable plasticizer, and an eatable adhesive, after the drink in the container contacts with said drink-decomposed plug, $CO_2$ gas is produced continuously, and said drink-decomposed plug is decomposed within 1 minute.

6. A container for spouting drink which contains gas, comprising:

a container structure comprising container body for containing the drink, wherein said container body has a container opening; and a control device, comprising: a drink-decomposed plug provided on said container opening for blocking said container opening, which is capable of being decomposed by the drink, a blocking element positioned inside said container body, for preventing said drink-decomposed plug from contacting with the drink, and a triggering element for disabling said blocking element, wherein when said triggering element disables said blocking element, the drink contacts with said drink-decomposed plug and starts decomposing said drink-decomposed plug, and after said drink-decomposed plug is completely decomposed, the drink spouts out of said container body, further comprising: a container cover having a concave central portion, which is mounted on said container opening, and has a device cover drink nozzle, wherein after said drink-decomposed plug is completely decomposed, the drink spouts out of said container via said device cover drink nozzle, and then falls back into said concave central portion of said container cover.

7. The container, as recited in claim 6, wherein the container further comprises:

a device cover;

a device cover central cylinder provided on a central portion of said device cover, wherein said device cover central cylinder has a device cover central cylinder drink channel and a device cover chamber, said device cover central cylinder drink channel is on an upper portion thereof, and said device cover chamber is on a lower portion thereof, wherein a top end of said device cover central cylinder drink channel has an opening on a top of said device cover central cylinder, and a bottom end communicated through an top end of said device cover chamber, wherein said drink-decomposed plug is positioned inside said device cover chamber for blocking said device cover central cylinder drink channel; and a sealing cover central cylinder thimble sleeve, wherein a bottom end of said device cover chamber has an opening on a bottom of said device cover central cylinder, an outer diameter of said device cover central cylinder is equal to an inner diameter of said sealing cover central cylinder thimble sleeve, said device cover central cylinder is sleeved inside said sealing cover central cylinder thimble sleeve.

8. The container, as recited in claim 6, wherein an opening of said top end of said device cover chamber has a screen mounted thereon and communicated through said device cover central cylinder drink channel, said opening of said top end of said device cover central cylinder drink channel is communicated through said device cover drink nozzle which is provided on a top end of said device cover.

9. The container, as recited in claim 7, wherein an opening of said top end of said device cover chamber has a screen mounted thereon and communicated through said device cover central cylinder drink channel, said opening of said top end of said device cover central cylinder drink channel is communicated through said device cover drink nozzle which is provided on a top end of said device cover.

10. The container, as recited in claim 6, wherein said screen and said device cover are formed integrally.

11. A control method of spouting drink containing gas, comprising:

providing a drink-decomposed plug on a container opening of a container body for blocking the container opening, which is capable of being decomposed by the drink; and disabling a blocking element positioned inside the container body for preventing said drink-decomposed plug from contacting with the drink, so as to allow the drink contacts with said drink-decomposed plug, wherein after said blocking element is disabled, the drink contacts with said drink-decomposed plug and starts decomposing said drink-decomposed plug, and after said drink-decomposed plug is completely decomposed, the drink spouts out of said container body, wherein said effervescent decomposed plug comprises an effervescent decomposed ingredient consisting of citric acid or tartaric acid, an eatable plasticizer, and an eatable adhesive, after the drink in the container contacts with said effervescent decomposed plug, $CO_2$ gas is produced continuously, and said effervescent decomposed plug is decomposed within 1 minute.

* * * * *